US007532172B2

(12) United States Patent
Kanno

(10) Patent No.: US 7,532,172 B2
(45) Date of Patent: May 12, 2009

(54) DIFFERENTIALLY-FED VARIABLE DIRECTIVITY SLOT ANTENNA

(75) Inventor: Hiroshi Kanno, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 12/147,091

(22) Filed: Jun. 26, 2008

(65) Prior Publication Data

US 2008/0284671 A1 Nov. 20, 2008

Related U.S. Application Data

(63) Continuation of application No. PCT/JP2007/072754, filed on Nov. 26, 2007.

(30) Foreign Application Priority Data

Nov. 30, 2006 (JP) ..... 2006-323382

(51) Int. Cl.
*H01Q 13/10* (2006.01)

(52) U.S. Cl. ..... 343/770; 343/767; 343/768; 343/846

(58) Field of Classification Search ..... 343/770, 343/767, 768, 846
See application file for complete search history.

(56) References Cited

U.S. PATENT DOCUMENTS

| | | | | |
|---|---|---|---|---|
| 6,531,984 | B1 | 3/2003 | Johannisson et al. | |
| 6,765,450 | B2 | 7/2004 | Howard et al. | |
| 6,864,848 | B2 * | 3/2005 | Sievenpiper | 343/767 |
| 7,215,284 | B2 * | 5/2007 | Collinson | 343/700 MS |
| 7,298,343 | B2 * | 11/2007 | Forster et al. | 343/767 |
| 7,336,233 | B2 * | 2/2008 | Thudor et al. | 343/767 |
| 7,403,170 | B2 * | 7/2008 | Kanno et al. | 343/770 |
| 2003/0122721 | A1 | 7/2003 | Sievenpiper | |
| 2004/0000959 | A1 | 1/2004 | Howard et al. | |
| 2005/0237252 | A1 | 10/2005 | Thudor et al. | |

FOREIGN PATENT DOCUMENTS

| | | |
|---|---|---|
| JP | 06-112732 | 4/1994 |
| JP | 2002-009540 | 1/2002 |
| JP | 2003-142919 | 5/2003 |
| JP | 2004-274757 | 9/2004 |

(Continued)

OTHER PUBLICATIONS

Gisin, F., et al., "Routing Differential I/O Signals Across Split Ground Planes at the Connector for EMI Control", Aug. 2000, 2000 IEEE International Symposium on Electromagnetic Compatibility Digest, vol. 1, 21-25, pp. 325-327.

(Continued)

*Primary Examiner*—Tho G Phan
(74) *Attorney, Agent, or Firm*—McDermott Will & Emery LLP

(57) ABSTRACT

With a differential feed line 103*c*, open-ended slot resonators 601, 603, 605, and 607 are allowed to operate in pair, a slot length of each slot resonator corresponding to a ¼ effective wavelength during operation. Slot resonators which are excited out-of-phase with an equal amplitude are allowed to appear within the circuitry. Thus, positioning condition of the open end points of the selective radiation portions 601*b*, 601*c*, 603*b*, 603*c*, 605*b*, and 607*b* in the respective slot resonators is dynamically switched.

7 Claims, 25 Drawing Sheets

FOREIGN PATENT DOCUMENTS

| | | | |
|---|---|---|---|
| JP | 2004-274757 | A | 9/2004 |
| JP | 2005-072915 | | 3/2005 |
| JP | 2005-514844 | | 5/2005 |
| JP | 2005-514844 | A | 5/2005 |
| JP | 2006-157176 | | 6/2006 |
| SU | 1675980 | A1 | 9/1991 |
| WO | WO 2005/117204 | A1 | 12/2005 |

OTHER PUBLICATIONS

Garg, R., et al., "Microstrip Antenna Design Handbook", 2001, pp. 441-443, Artech House Publishers.

Zhu, L., et al., "A Novel Broadband Microstrip-Fed Wide Slot Antenna With Double Rejection Zeros", IEEE Antennas and Wireless Propagation Letters, 2003, pp. 194-196, vol. 2.

Co-pending U.S. Application: Continuation Application of PCT/JP2008/050553, filed Jun. 26, 2008.

Japanese Decision to Grant issued in Patent Application No. JP 2008-517058.

International Search Report issued in Patent Application No, PCT/JP2007/072754 dated on Feb. 26, 2008.

* cited by examiner

YZ-plane

XZ-plane

XY-plane

YZ-plane

XZ-plane

XY-plane

YZ-plane

XZ-plane

XY-plane

YZ-plane

XZ-plane

XY-plane

XY-plane

XZ-plane

YZ-plane

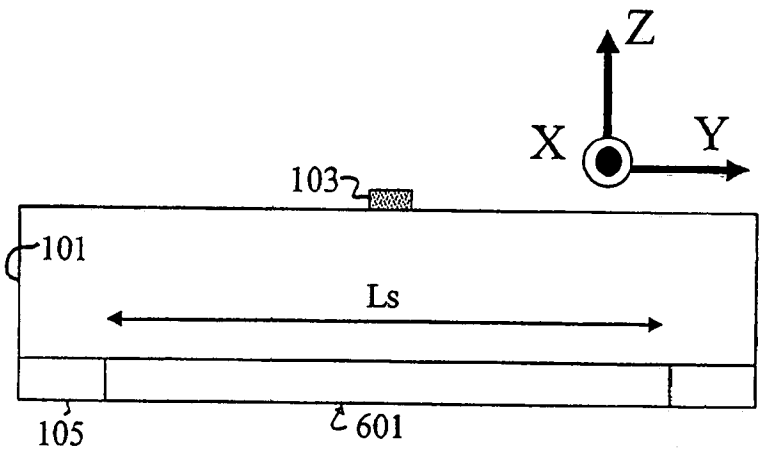
FIG.17B – PRIOR ART –
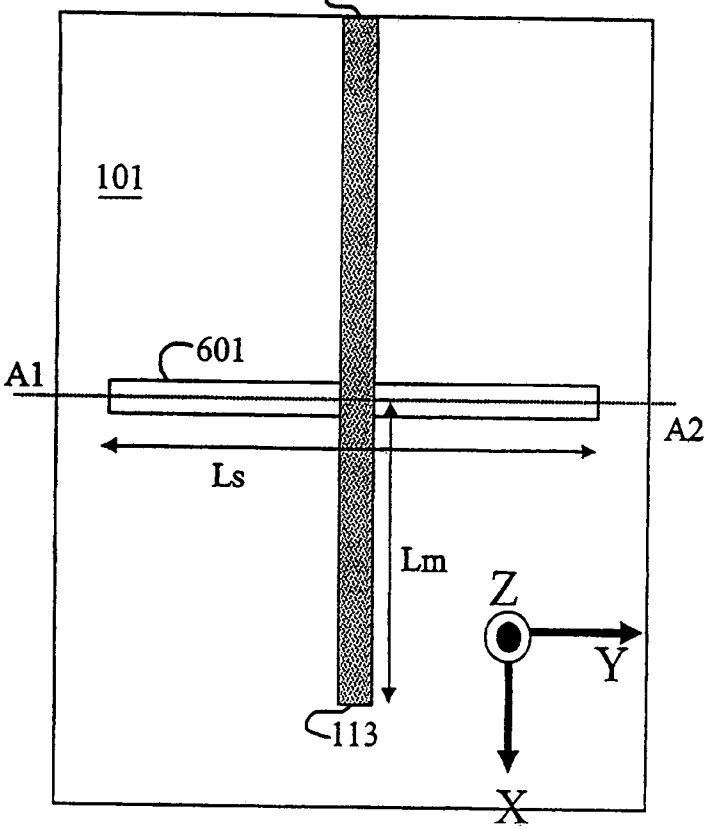
FIG.17A – PRIOR ART –

XZ-plane

*– PRIOR ART –*

YZ-plane

*– PRIOR ART –*

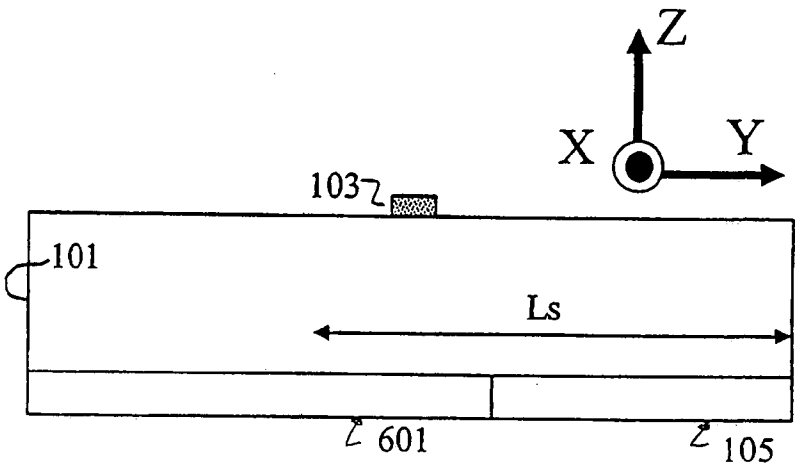
FIG. 19B – PRIOR ART –
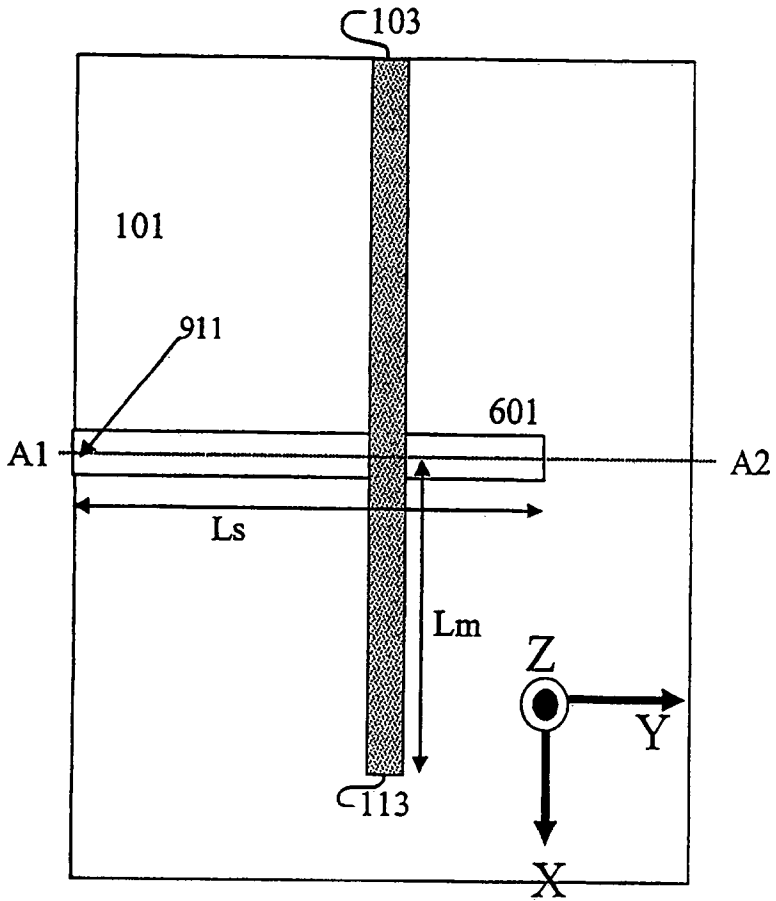
FIG. 19A – PRIOR ART –

YZ-plane

*– PRIOR ART –*

XZ-plane

*– PRIOR ART –*

XY-plane

*– PRIOR ART –*

*– PRIOR ART –*

*– PRIOR ART –*

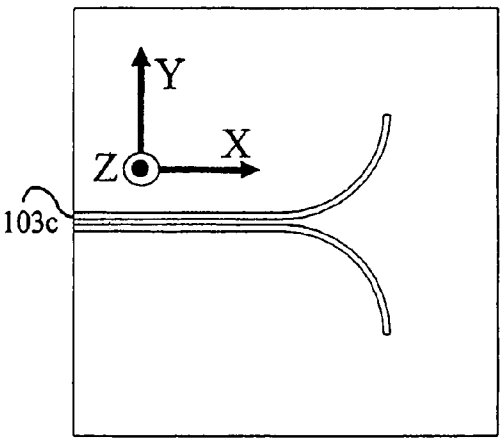
FIG.22B - PRIOR ART -
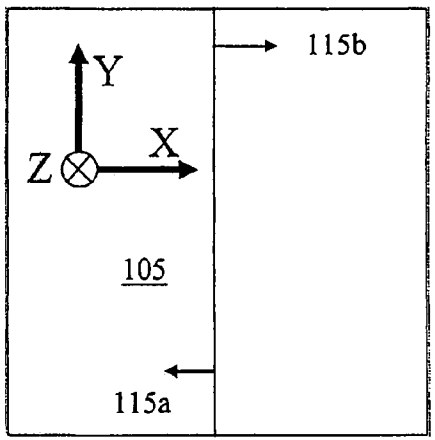
FIG.22C - PRIOR ART -
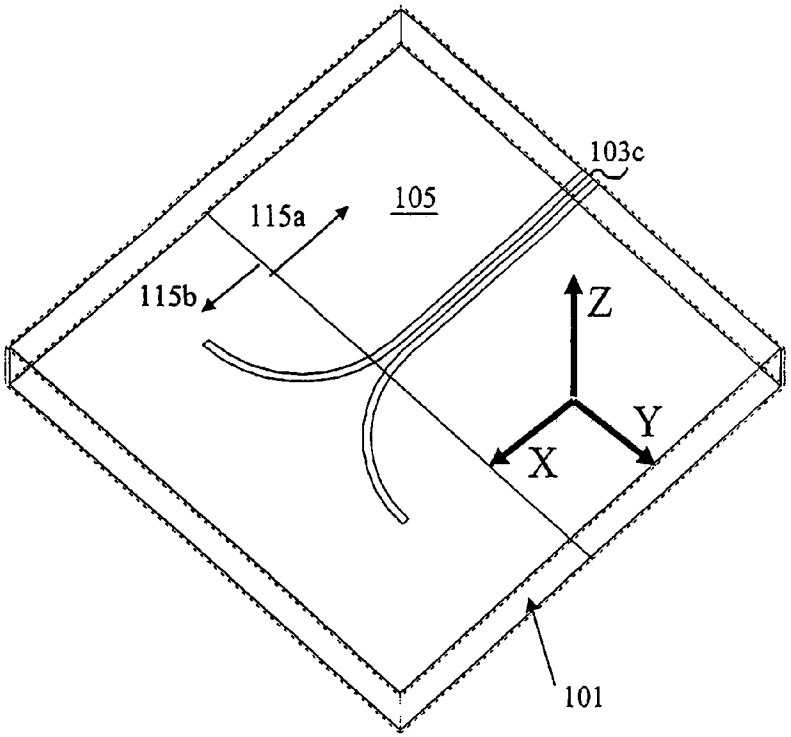
FIG.22A - PRIOR ART -

XZ-plane

*– PRIOR ART –*

YZ-plane

*– PRIOR ART –*

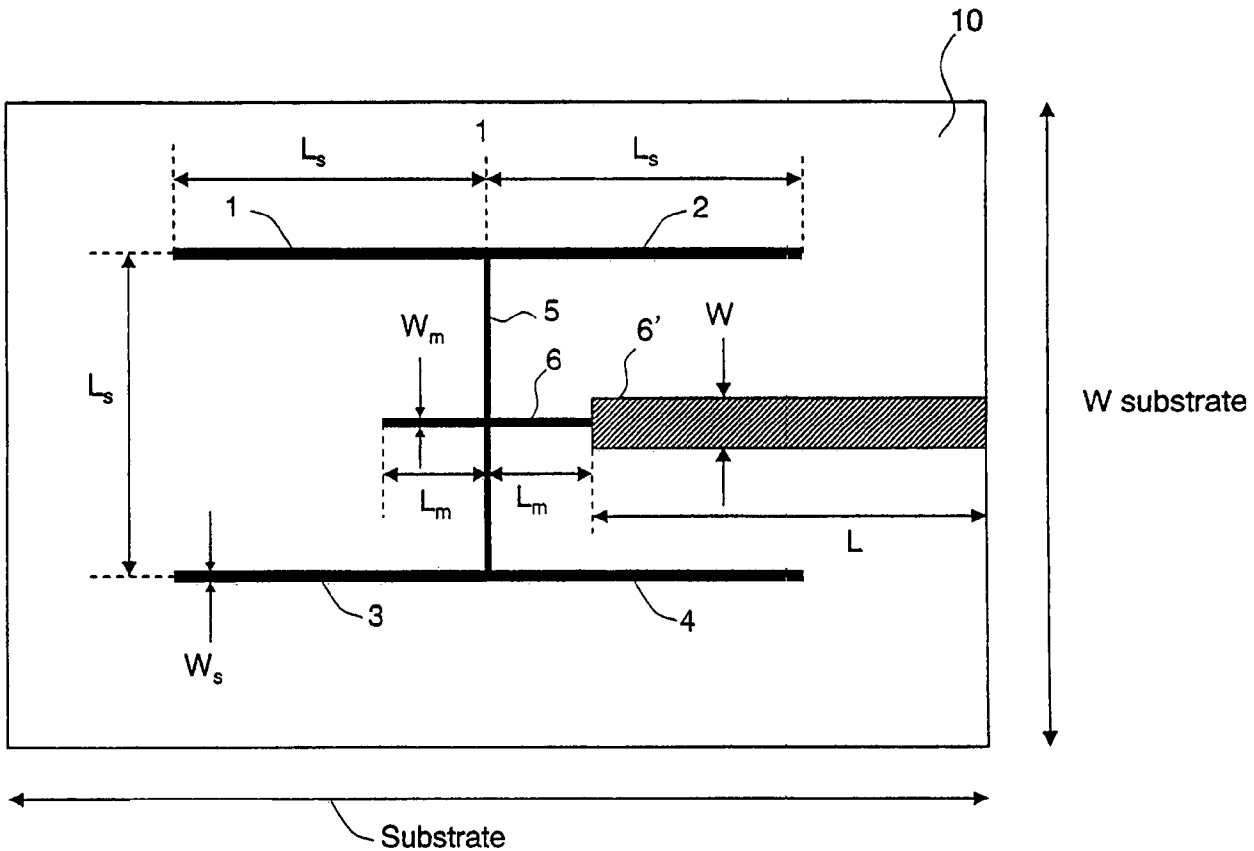
FIG.24– PRIOR ART –

DIFFERENTIALLY-FED VARIABLE DIRECTIVITY SLOT ANTENNA

This is a continuation of International Application No. PCT/JP2007/072754, with an international filing date of Nov. 26, 2007, which claims priority of Japanese Patent Application No. 2006-323382, filed on Nov. 30, 2006, the contents of which are hereby incorporated by reference.

BACKGROUND OF THE INVENTION

1. Field of the Invention

The present invention relates to a differentially-fed antenna with which a digital signal or an analog high-frequency signal, e.g., that of a microwave range or an extremely high frequency range, is transmitted or received.

2. Description of the Related Art

In recent years, drastic improvements in the characteristics of silicon-type transistors have led to an accelerated trend where compound semiconductor transistors are being replaced by silicon-type transistors not only in digital circuitry but also in analog high-frequency circuitry, and where analog high-frequency circuitry and digital baseband circuitry are being made into a single chip.

As a result of this, single-ended circuits (which have been in the mainstream of high-frequency circuits) are being replaced by differential signal circuits which undergo a balanced operation of signals of positive and negative signs. This is because a differential signal circuit provides advantages such as drastic reduction in unwanted radiation, obtainment of good circuit characteristics under conditions which do not allow an infinite area of ground conductor to be disposed within a mobile terminal device, and so on. The individual circuit elements in a differential signal circuit need to operate under a balance. Silicon-type transistors do not have much variation in characteristics, and make it possible to maintain a differential balance between signals. Another reason is that differential lines are also preferable for avoiding the loss that is associated with the silicon substrate itself. This has resulted in a strong desire for high-frequency devices, such as antennas and filters, to support differential signal feeding while maintaining the high high-frequency characteristics that have been established in single-ended circuits.

FIG. 17A shows a schematic see-through view as seen from the upper face, and FIG. 17B shows a cross-sectional structural diagram taken along line A1-A2 in the figure; this is a ½ wavelength slot antenna (Conventional Example 1) which is fed through a single-ended line 103. On a ground conductor surface 105 which is formed on the rear face of a dielectric substrate 101, a slot resonator 601 having a slot length Ls corresponding to a ½ effective wavelength is formed. In order to satisfy the input matching conditions, a distance Lm from an open-end point 113 of the single-ended line 103 until intersecting the slot 601 is set to a ¼ effective wavelength at the operating frequency. The slot resonator 601 is obtained by removing the conductor completely across the thickness direction in a partial region of the ground conductor surface 105. As shown in the figure, a coordinate system is defined in which a direction that is parallel to a transmission direction in the feed line is the X axis and the plane of the dielectric substrate is the XY plane. Typical examples of radiation directivity characteristics of Conventional Example 1 are shown in FIGS. 18A and 18B. FIG. 18A shows a radiation directivity in the YZ plane, whereas FIG. 18B shows a radiation directivity in the XZ plane. As is clear from these figures, Conventional Example 1 provides radiation directivity characteristics that exhibit a maximum gain in the ±Z direction. Moreover, null characteristics are obtained in the ±X direction, and even in the ±Y direction, a gain reduction effect of about 10 dB relative to the main beam direction is obtained.

On the other hand, FIG. 19A shows a schematic see-through view as seen from the upper face, and FIG. 19B shows a cross-sectional structural diagram taken along line A1-A2 in the figure; this is a ¼ wavelength slot antenna (Conventional Example 2) which is fed through a single-ended line 103. On a ground conductor 105 having an finite area and being formed on the rear face of a dielectric substrate 101, a slot resonator 601 having a slot length Ls corresponding to a ¼ effective wavelength is formed. One end 911 of the slot resonator is left open-ended at an edge of the ground conductor 105. FIG. 20A shows a radiation directivity in the YZ plane; FIG. 20B shows a radiation directivity in the XZ plane; and FIG. 20C shows a radiation directivity in the XY plane. As is clear from these figures, Conventional Example 2 provides broad radiation directivity characteristics that exhibit a maximum gain in the −Y direction.

U.S. Pat. No. 6,765,450 (hereinafter "Patent Document 1") discloses a circuit structure in which the aforementioned slot structure is disposed immediately under a differential feed line so as to be orthogonal to the transmission direction (Conventional Example 3). That is, the circuit construction of Patent Document 1 is a construction in which the circuit for feeding the slot resonator is changed from a single-ended line to a differential feed line. Patent Document 1 has an objective to realize a function of selectively reflecting only an unwanted in-phase signal that has been unintentionally superposed on a differential signal. As is clear from this objective, the circuit structure disclosed in Patent Document 1 does not have a function of radiating a differential signal into free space. FIGS. 21A and 21B schematically illustrate field distributions occurring in a ½ wavelength slot resonator in the cases where it is fed through a single-ended line and a differential feed line, respectively. In the case of the slot being fed through a single-ended line, electric fields 201 are distributed along the slot width direction so that a minimum intensity exists at both ends and a maximum intensity exists in the central portion. On the other hand, in the case of the slot being fed through a differential feed line, electric fields 201*a* which occur in the slot due to a voltage of the positive sign and electric fields 201*b* which occur in the slot due to a voltage of the negative sign are at an equal intensity and have vectors in opposite directions. Thus, in total, both electric fields cancel out each other. Therefore, even the ½ wavelength slot resonator is fed through a differential feed line, efficient radiation of electromagnetic waves would be impossible according to principles. Similarly, if the ½ wavelength slot resonator is replaced by a ¼ wavelength slot resonator, it still holds that out-of-phase voltages being fed from excitation points in a near proximity would cancel out each other, thus hindering efficient radiation. Therefore, as compared to the case of feeding via a single-ended line, it is not easy to realize practical antenna characteristics by allowing a differential feed line to couple to a slot resonator structure.

Non-Patent Document 1 ("Routing differential I/O signals across split ground planes at the connector for EMI control" IEEE International Symposium on Electromagnetic Compatibility, Digest Vol. 1 21-25 pp. 325-327 August 2000) reports that, by splitting a ground conductor on the rear face of a differential line to form a slot structure with open ends, elimination of the in-phase mode which has been unintentionally superposed on the line becomes possible. Clearly in this case, too, the objective is not meant to be an efficient radiation of differential signal components.

In general, in order to efficiently radiate electromagnetic waves from a differential transmission circuit, no slot resonator is used. Rather, a method is employed in which the interspace between two signal lines of a differential feed line is increased to realize an operation as a dipole antenna (Conventional Example 4). FIG. 22A shows a perspective schematic see-through view of a differentially-fed strip antenna; FIG. 22B shows an upper schematic view thereof; and FIG. 22C shows a lower schematic view thereof. In FIGS. 22A to 22C, coordinate axes are set similarly to FIG. 17.

In a differentially-fed strip antenna, the line interspace of a differential feed line 103*c* which is formed on the upper face of a dielectric substrate 101 has a tapered increase at the ends. At the rear face side of the dielectric substrate 101, a ground conductor 105 is formed in a region 115*a* which is closer to the input terminal, whereas no ground conductor is formed in a region 115*b* lying immediately under the ends of the differential feed line 103*c*. Typical examples of radiation directivity characteristics of Conventional Example 4 are shown in FIGS. 23A and 23B. FIG. 23A shows radiation directivity characteristics in the YZ plane, whereas FIG. 23B shows radiation directivity characteristics in the XZ plane. As is clear from these figures, in Conventional Example 4, the main beam direction is the +X direction, and Conventional Example 4 exhibits radiation characteristics with a broad half-width distributed over the XZ plane. According to principles, no radiation gain in the ±Y direction is obtained in Conventional Example 4. Radiation in the minus X direction can be suppressed since the emitted electromagnetic waves are reflected by the ground conductor 105.

On the other hand, Japanese Laid-Open Patent Publication No. 2004-274757 (hereinafter "Patent Document 2"; Conventional Example 5) discloses a variable slot antenna which is fed through a single-ended line. FIG. 1 of Patent Document 2 is shown herein as FIG. 24. This construction is similar to Conventional Example 1 in that a ½ wavelength slot resonator 5 which is formed on the substrate rear face is fed through a single-ended line 6 which is disposed on the front face of the dielectric substrate 10. However, at the leading end of the ½ wavelength slot resonator 5 being fed, a plurality of ½ wavelength slot resonators 1, 2, 3, and 4 are further provided for selective connection, thus realizing highly-free slot resonator positioning. It is described that changing the slot resonator positioning realizes a function of changing the main beam direction of electromagnetic waves.

Conventional differentially-fed antennas, slot antennas, and variable antennas have the following problems associated with their principles.

Firstly, in Conventional Example 1, the main beam can only be directed in the ±Z axis direction, and it is difficult to direct the main beam direction in the ±Y axis direction or the ±X axis direction. What is more, since differential feeding is not yet supported, it is necessary to employ a balun circuit for feed signal conversion, thus resulting in the problems of increased elements, hindrance of integration, and the like.

Secondly, in Conventional Example 2, although a broad main beam in the +Y direction is formed, it is difficult to form beams in any other directions. What is more, since differential feeding is not yet supported, it is necessary to employ a balun circuit for feed signal conversion, thus resulting in the problems of increased elements, hindrance of integration, and the like. Moreover, the radiation characteristics of Conventional Example 2 have a broad half-width, which makes it difficult to avoid deterioration in quality of communications. For example, if a desired signal comes in the −Y direction, the reception intensity of any unwanted signal that comes in the +X direction will not be suppressed. Thus, it is very difficult to avoid serious multipath problems which may occur when performing high-speed communications in an indoor environment with a lot of signal returns, and maintain the quality of communications in a situation where a lot of interference waves may arrive.

Thirdly, as described with respect to Conventional Example 3, only non-radiation characteristics can be attained by a ½ wavelength slot resonator or a ¼ wavelength slot resonator in which feeding via a single-ended line is merely replaced with feeding via a differential feed line. Thus, it is difficult to obtain an efficient antenna operation.

Fourthly, with Conventional Example 4, it is difficult to direct the main beam in the ±Y axis direction. Note that bending the feed line in order to deflect the main beam direction is not an available solution in Conventional Example 4 because, if the differential line is bent, the reflection of an unwanted in-phase signal will occur due to a phase difference between the two wiring lines at the bent portion. As an antenna for a mobile terminal device to be used in an indoor environment, it is highly unpreferable that the main beam cannot be directed in a certain direction.

Fifthly, the radiation characteristics of Conventional Example 4 have a broad half-width, which makes it difficult to avoid deterioration in quality of communications. For example, if a desired signal comes in the Z axis direction, the reception intensity of any unwanted signal that comes in the +X direction will not be suppressed. Thus, it is very difficult to avoid serious multipath problems which may occur when performing high-speed communications in an indoor environment with a lot of signal returns, and maintain the quality of communications in a situation where a lot of interference waves may arrive.

Sixthly, as in the aforementioned fourth problem, it is also difficult in Conventional Example 5 to prevent the quality of communications from being unfavorably affected by an unwanted signal coming in a direction which is different from the direction in which a desired signal arrives. In other words, even if the main beam direction is controllable, there is still a problem of inadequate suppression of interference waves. Of course, as in the aforementioned first problem, differential feeding is not yet supported.

In summary, by using any of the conventional techniques, it is impossible to realize a variable antenna which solves the following three problems: 1) affinity with differential feed circuitry; 2) ability to switch the main beam direction within a wide range of solid angles; and 3) suppression of interference waves coming in any direction other than the main beam direction.

SUMMARY OF THE INVENTION

It is an objective of the present invention to provide a variable antenna which solves the aforementioned three conventional problems, and which preferably has characteristics such that a plurality of radiation patterns that are obtained through variable control act in a complementary manner to encompass all solid angles.

A differentially-fed variable directivity slot antenna according to the present invention is a differentially-fed variable directivity slot antenna comprising: a dielectric substrate (101); a ground conductor (105) provided on a rear face of the dielectric substrate, the ground conductor having a finite area; a differential feed line (103*c*) disposed on a front face of the dielectric substrate, the differential feed line being composed of two mirror symmetrical signal conductors (103*a*, 103*b*); a first slot resonator (601, 605) formed in the ground conductor (105), a portion of the first slot resonator intersecting one (103*a*) of the signal conductors (103*a*, 103*b*), the first slot resonator having a slot length corresponding to a ¼ effective wavelength at an operating frequency and having an open end; and a second slot resonator (603, 607) formed in the ground conductor (105), a portion of the second slot resonator intersecting the signal conductor (103*b*) other than the signal conductor (103*a*) intersected by the portion of the first slot resonator, the second slot resonator having a slot length corresponding to a ¼ effective wavelength at the operating frequency and having an open end, wherein, the first slot resonator (601, 605) and the second slot resonator (603, 607) are fed out-of-phase, and at least one of the slot resonators (601, 603, 605, 607) has at least one function of an RF structure reconfigurability function and an operation status switching function, thus realizing two or more different radiation directivities; the first and second slot resonators (601, 603, 605, 607) each comprise a series connection structure including a feeding portion (601*a* to 607*a*) partly intersecting the signal conductor (103*a*, 103*b*) and a selective radiation portion (601*b*, 601*c*, 603*b*, 603*c*, 605*b*, 605*c*, 607*b*, 607*c*) not intersecting the signal conductor (103*a*, 103*b*); in a region facing a region between the first signal conductor and the second signal conductor, at least a portion of the feeding portion has a component being oriented in a direction parallel to the signal conductors and extending a length of less than a ⅛ effective wavelength to be short-circuit-ended; the selective radiation portion is open-ended at a leading end opposite from an end where the selective radiation portion is connected to the feeding portion; in the at least one slot resonator (601, 603, 605, 607) having the at least one function, a plurality of said selective radiation portions are connected to the feeding portion, with a high-frequency switch (601*d*, 601*e*) being inserted so as to straddle the slot resonator along a width direction in at least one place in a path from the feeding portion to each of the open points (601*bop*, 601*cop* to 607*bop*, 607*cop*) of the plurality of selective radiation portions, each high-frequency switch providing control as to whether or not to short-circuit the ground conductor on both sides astride the slot resonator; the RF structure reconfigurability function is realized by one of the plurality of selective radiation portions being selected via the high-frequency switches to form a slot structure together with the feeding portion; and the operation status switching function is realized by the high-frequency switches short-circuiting each slot structure.

In a preferred embodiment, the first slot resonator and the second slot resonator are each fed at a point whose distance from an open end of the differential feed line toward the feed circuit corresponds to a ¼ effective wavelength at the operating frequency.

In a preferred embodiment, an end point of the differential feed line is grounded via resistors of a same resistance value.

In a preferred embodiment, an end point of the first signal conductor and an end point of the second signal conductor are electrically connected to each other via a resistor.

In a preferred embodiment, one of the two or more different radiation directivities is a radiation directivity being orthogonal to the differential feed line and having radiation components in two directions which are parallel to the dielectric substrate, the radiation directivity being realized by: designating two pairs of slot resonators, in each of which a first open leading portion of a first selective radiation portion of the first slot resonator and a second open leading portion of a second selective radiation portion of the second slot resonator are disposed at a distance of less than a ¼ effective wavelength at the operating frequency from each other; disposing the first open leading portion in the first pair of slot resonators and the first open leading portion in the second pair of slot resonators so as to be apart by about ½ effective wavelength at the operating frequency; and disposing the second open leading portion in the first pair of slot resonators and the second open leading portion in the second pair of slot resonators so as to be apart by about ½ effective wavelength at the operating frequency.

In a preferred embodiment, one of the two or more different radiation directivities is a radiation directivity having radiation components in two directions which are parallel to the differential feed line, the radiation directivity being realized by: designating two pairs of slot resonators, in each of which a first open leading portion of a first selective radiation portion of the first slot resonator and a second open leading portion of a second selective radiation portion of the second slot resonator are separated by about a ½ effective wavelength at the operating frequency from each other; disposing the first open leading portion in the first pair of slot resonators and the first open leading portion in the second pair of slot resonators so as to be apart by about ½ effective wavelength at the operating frequency; and disposing the second open leading portion in the first pair of slot resonators and the second open leading portion in the second pair of slot resonators so as to be apart by about ½ effective wavelength at the operating frequency.

In a preferred embodiment, one of the two or more different radiation directivities is realized by: disposing the first open leading portion of the first selective radiation portion of the first slot resonator and the second open leading portion of the second selective radiation portion of the second slot resonator so as to be apart by about ½ effective wavelength at the operating frequency; and setting only one pair of slot resonators in the differentially-fed variable directivity slot antenna into an operating state to operate in pair, whereby, a radiation gain in a first direction connecting the first open leading portion and the second open leading portion is suppressed; and a main beam is directed in a direction within a plane which is orthogonal to the first direction.

In a differentially-fed variable directivity slot antenna according to the present invention, by using the reconfigurability of a slot resonator pair being fed out-of-phase, not only is it possible to realize an efficient radiation such that a main beam direction is oriented in directions which are difficult to be attained by conventional differentially-fed antennas, but it is also possible, according to natural principles, to simultaneously suppress radiation gain in directions different from the main beam direction. Thus, the three problems of conventional antennas can be solved. There is a very wide angle range in which the present antenna is able to direct the main beam direction, and it is even possible to cover all solid angles.

Thus, a differentially-fed variable directivity slot antenna according to the present invention attains the following three effects: firstly, efficient radiation is obtained in directions which are not available with conventional differentially-fed antennas; secondly, the main beam direction is variable within a wide range of solid angles; and thirdly, according to natural principles, gain suppression is realized in a direction that is different from the main beam direction. Therefore, the antenna is very useful as an antenna for a mobile terminal device to be used in an indoor environment for high-speed communications purposes.

Other features, elements, processes, steps, characteristics and advantages of the present invention will become more apparent from the following detailed description of preferred embodiments of the present invention with reference to the attached drawings.

BRIEF DESCRIPTION OF THE DRAWINGS

FIG. 2A is a cross-sectional structural diagram taken along line A1-A2 in FIG. 1. FIG. 2B is a cross-sectional structural diagram taken along line B1-B2 in FIG. 1. FIG. 2C is a cross-sectional structural diagram taken along line C1-C2 in FIG. 1.

FIG. 5A is a structural diagram of a slot resonator which emerges owing to an RF structure reconfigurability function. FIG. 5B is a structural diagram of a slot resonator which emerges owing to an RF structure reconfigurability function. FIG. 5C is a structural diagram of a slot resonator which is controlled to a non-operating state by an operation status switching function.

FIGS. 17A and 17B are structural diagrams of a single-ended line feed ½ wavelength slot antenna (Conventional Example 1). FIG. 17A is an upper schematic see-through view. FIG. 17B is a cross-sectional structural diagram.

FIG. 18A is a radiation directivity characteristics diagram in the YZ plane. FIG. 18B is a radiation directivity characteristics diagram in the XZ plane.

FIGS. 19A and 19B are structural diagrams of a single-ended line feed ¼ wavelength slot antenna (Conventional Example 2). FIG. 19A is an upper schematic see-through view. FIG. 19B is a cross-sectional structural diagram.

FIG. 20A is a radiation directivity characteristics diagram in the YZ plane. FIG. 20B is a radiation directivity characteristics diagram in the XZ plane.

FIG. 21A is a schematic diagram in the case of feeding through a single-ended feed line. FIG. 21B is a schematic diagram in the case of feeding through a differential feed line.

FIGS. 22A and 22B are structural diagrams of a differentially-fed strip antenna (Conventional Example 4). FIG. 22A is a perspective schematic see-through view. FIG. 22B is an upper schematic view. FIG. 22C is a lower schematic view.

FIG. 23A is a radiation directivity characteristics diagram in the YZ plane. FIG. 23B is a radiation directivity characteristics diagram in the XZ plane.

FIG. 24, which is FIG. 1 of Patent Document 2 (Conventional Example 5), is a schematic structural diagram of a single-ended feed variable antenna.

DETAILED DESCRIPTION OF PREFERRED EMBODIMENTS

Hereinafter, an embodiment of the differentially-fed variable directivity slot antenna according to the present invention will be described. According to the present embodiment, it is possible to attain dynamic variability of radiation directivity for realizing efficient radiation in various directions, including directions in which conventional differentially-fed antennas cannot provide radiation. Furthermore, it is also possible to realize an industrially useful effect of suppressing the radiation gain in a direction which is different from the main beam direction.

Embodiment

Figure 1:
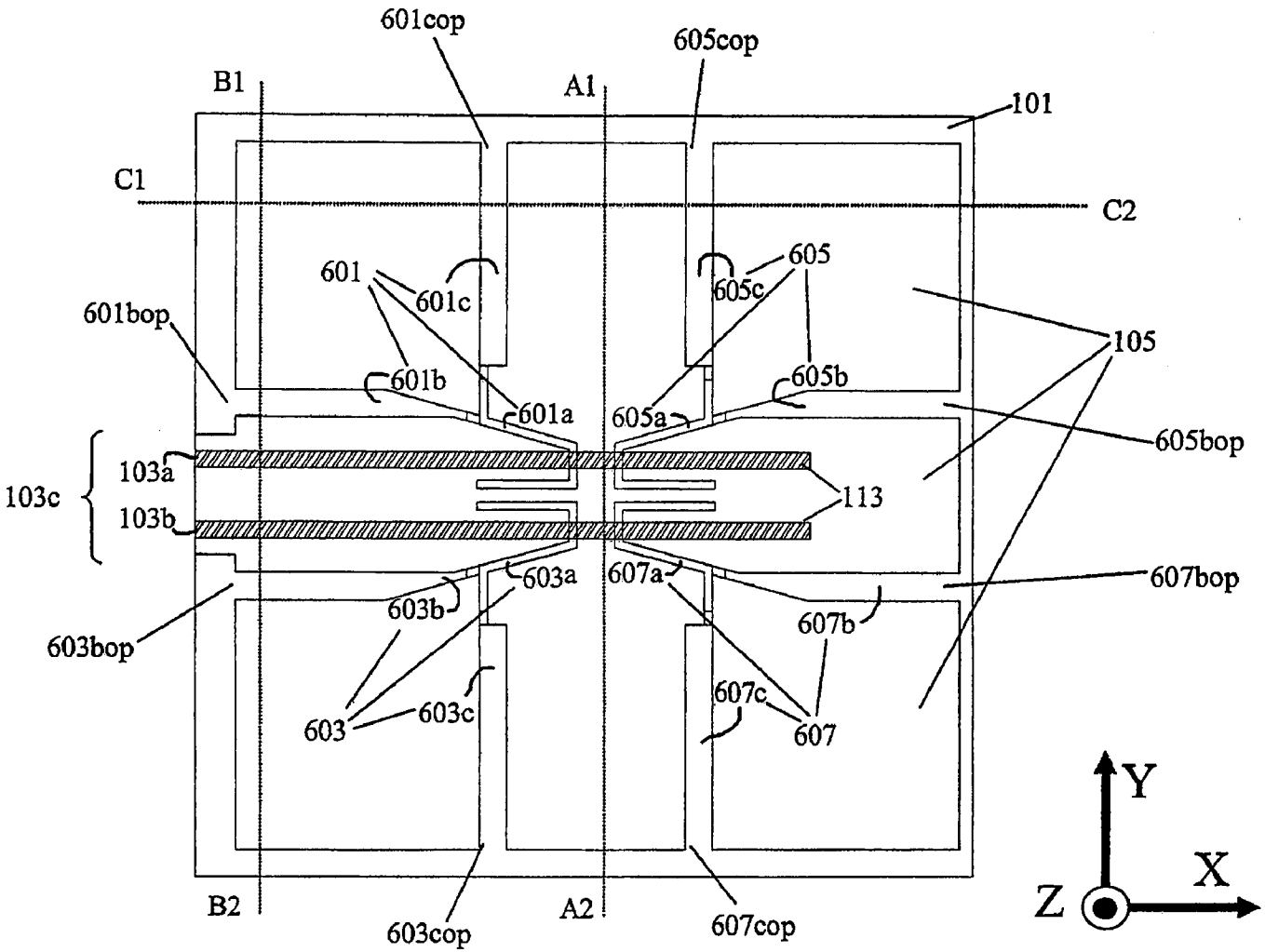
FIG. 1 is a schematic see-through view of an embodiment of the differentially-fed variable directivity slot antenna according to the present invention as seen from above an upper face.
Figures 2A, 2B, 2C:
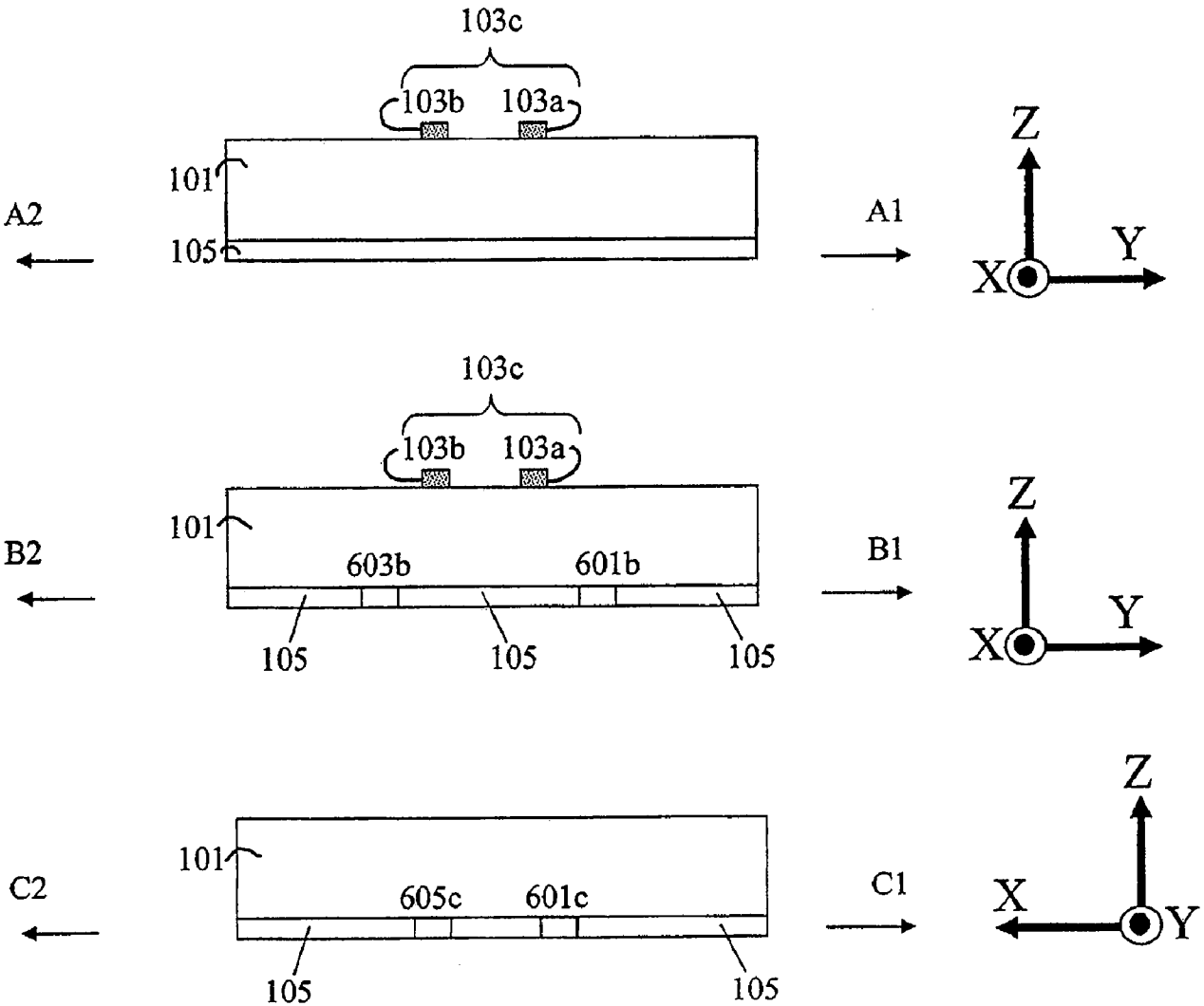
FIGS. 2A, 2B, and 2C are cross-sectional structural diagrams of the differentially-fed variable directivity slot antenna embodiment of FIG. 1.

FIG. 1 shows the structure of an embodiment of the differentially-fed slot antenna according to the present invention, and provides a schematic see-through view as seen through a ground conductor on the rear face of a dielectric substrate. FIGS. 2A to 2C are cross-sectional structural diagrams of the circuit structure taken along line A1-A2, line B1-B2, and line C1-C2 in FIG. 1, respectively. The coordinate axes and signs in the figures correspond to the coordinate axes and signs in FIGS. 17A and 17B and FIGS. 22A to 22C showing constructions and radiation directions of Conventional Examples.

As shown in FIG. 1, a ground conductor 105 having a finite area is formed on the rear face of a dielectric substrate 101, and a differential feed line 103*c* is formed on the front face of the dielectric substrate 101. The differential feed line 103*c* is composed of a mirror symmetrical pair of signal conductors 103*a* and 103*b*. In partial regions of the ground conductor 105, the conductor is removed completely across the thickness direction to form slot circuits (i.e., a slot resonator 601 and the like).

Figure 3:
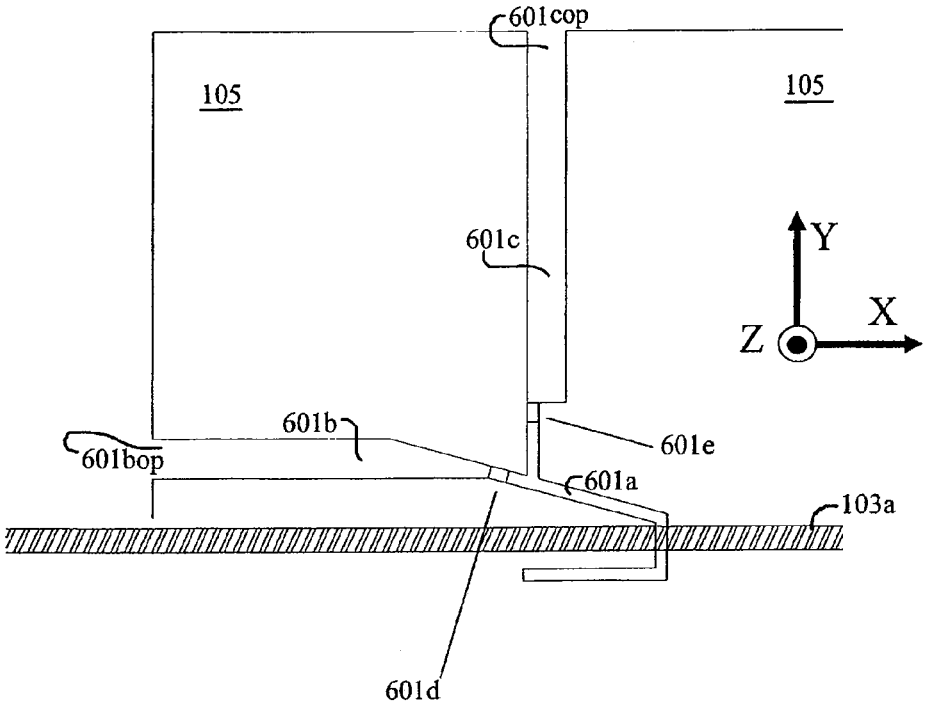
FIG. 3 is an enlarged view showing the neighboring structure of a slot resonator 601.

In the example of FIG. 1, four slot resonators 601, 603, 605, and 607 are provided in the ground conductor 105. FIG. 3 shows an enlarged view of the neighboring structure of the slot resonator 601. The slot resonator 601 includes a feeding portion 601*a* which is in series connection to a first selective radiation portion 601*b* and also in series connection to a second selective radiation portion 601*c*. The number of selective radiation portions to be connected to one feeding portion is not limited to the number illustrated in the present embodiment (i.e., two).

Among the plurality of slot resonators, at least one slot resonator has at least one function of either an RF structure reconfigurability function or an operation status switching function. The RF structure reconfigurability function and the operation status switching function are executed in response to an externally-supplied control signal (external control signal).

FIG. 3 shows, enlarged, the neighborhood of the slot resonator 601, which is capable of realizing both of the RF structure reconfigurability function and the operation status switching function. In order to realize such functions, the external control signal controls a first high-frequency switching element 601*d* which is disposed between the feeding portion 601*a* and the first selective radiation portion 601*b*, and also controls a second high-frequency switching element 601*e* which is disposed between the feeding portion 601*a* and the second selective radiation portion 601*c*. The high-frequency switching elements 601*d* and 601*e* may straddle a portion of the selective radiation portions 601*b* and 601*c*, respectively. Each selective radiation portion (601*b* and 601*c*) reaches an edge of the ground conductor 105 at its leading end opposite from the end at which it is connected to the feeding portion 601*a*, thus being left open-ended at the open end point (601*bop*, 601*cop*).

Figure 4:
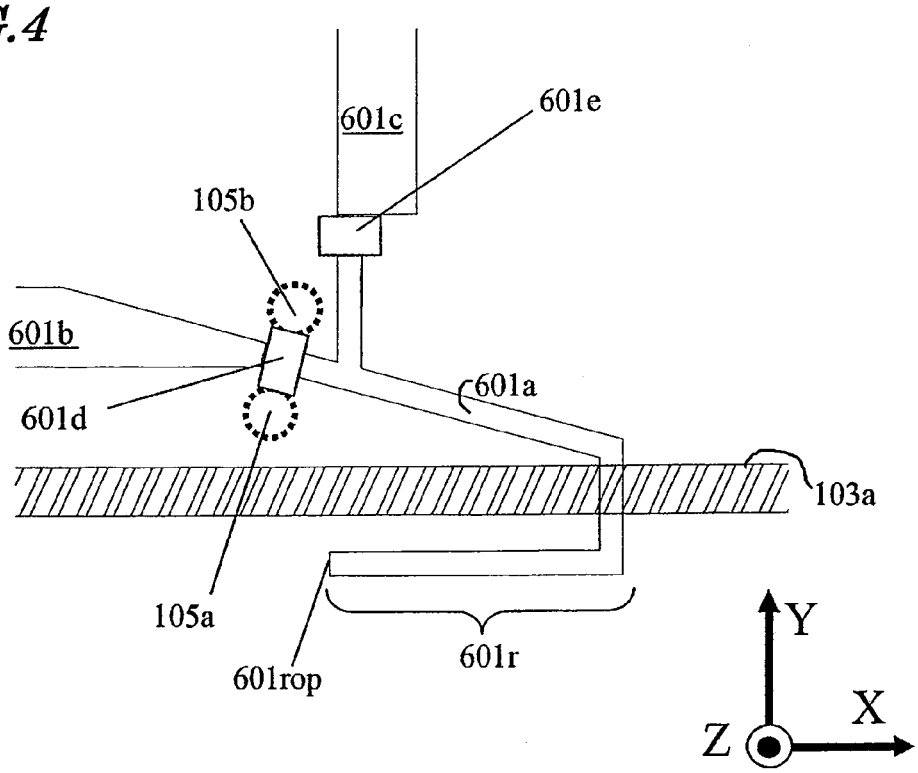
FIG. 4 is an enlarged structural diagram within the slot resonator 601.

FIG. 4 shows, enlarged, the vicinity of the high-frequency switching elements 601*d* and 601*e*. For example, the high-frequency switching element 601*d* provides control as to whether or not to connect between ground conductor regions 105*a* and 105*b* which are on both sides astride the slot. When the high-frequency switching element 601*e* is controlled to be in an open state, the open end 601*cop* of the selective radiation portion 601*c* is in series connection to the feeding portion 601*a* in high-frequency terms, thus functioning as an end point of a ¼ effective wavelength slot resonator. On the other hand, when the high-frequency switching element 601*e* is controlled to be in a conducting state, the open end 601*cop* of the selective radiation portion 601*c* is isolated from the feeding portion 601*a* in high-frequency terms, thus not functioning as an end point of a ¼ effective wavelength slot resonator. Thus, through control of the high-frequency switching elements, it is possible to realize switching as to whether the high-frequency structure of the slot resonator 601 appearing on the ground conductor 105 is allowed to function or not. Note that the position of the high-frequency switching element 601*d* does not need be between the selective radiation portion 601*c* and the feeding portion 601*a*. The high-frequency switching element 601*d* may straddle the slot structure along the width direction in any place other than the open ends 601*bop* and 601*cop* of the selective radiation portions 601*b* and 601*c*.

Each slot resonator having the RF structure reconfigurability function includes at least two selective radiation portions. However, the number of selective radiation portions to be selected within the slot resonator during operation is limited to one. The remaining unselected selective radiation portion, especially its open end point, is isolated from the slot resonator in high-frequency terms.

Figures 5A, 5B, 5C:
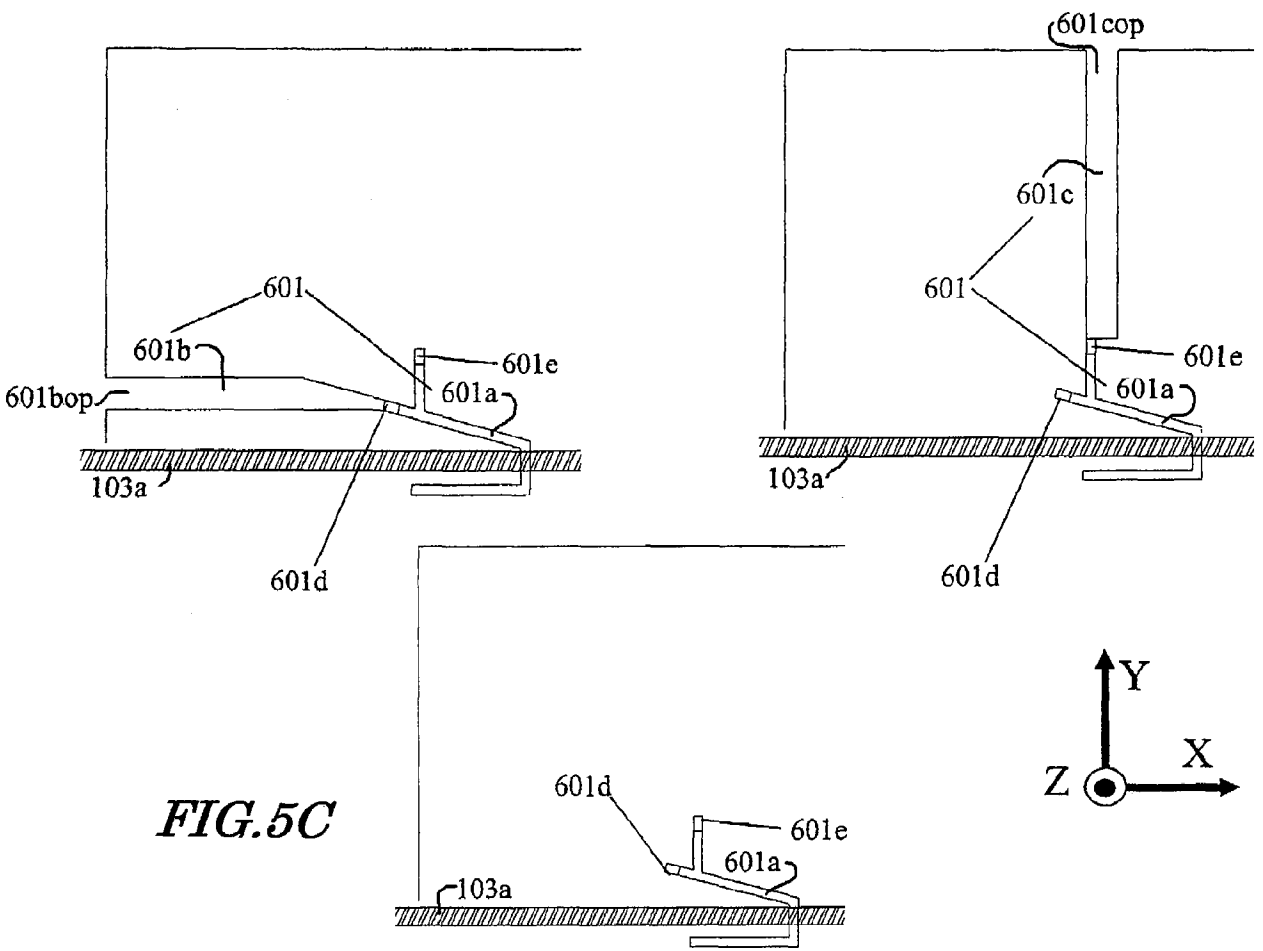
FIGS. 5A, 5B, and 5C are diagrams showing examples of reconfigurability of the slot resonator 601.

FIGS. 5A to 5C show examples of changing high-frequency structures of the slot resonator 601 in FIG. 3. In FIGS. 5A to 5C, each unselected selective radiation portion is obscured. In the example shown in FIG. 5A, the high-frequency switching element 601*d* is open, whereas the high-frequency switching element 601*e* is conducting, i.e., short-circuited. As a result, connection between the feeding portion 601*a* and the selective radiation portion 601*c* is terminated, so that a slot resonator structure is created in which the feeding portion 601*a* and the selective radiation portion 601*b* are connected in series. In this case, the open point of the ¼ effective wavelength slot resonator 601 is the portion denoted by reference numeral "601*bop*".

On the other hand, in the example shown in FIG. 5B, the high-frequency switching element 601*d* is conducting, whereas the high-frequency switching element 601*e* is open. As a result, connection between the feeding portion 601*a* and the selective radiation portion 601*b* is terminated, so that a slot resonator structure is created in which the feeding portion 601*a* and the selective radiation portion 601*c* are connected in series. In this case, the open point of the ¼ effective wavelength slot resonator 601 is the portion denoted by reference numeral "601*cop*".

The operation status switching function is a function to enable switching of the slot resonator itself between an operating state and a non-operating state. FIG. 5C shows a structure in the case where the slot resonator 601 of FIG. 3 is switched to a non-operating state. By controlling both of the high-frequency switching elements 601*d* and 601*e* to be in a conducting state, all of the selective radiation portions that are connected to the feeding portion 601*a*, and furthermore all of the open end points, are isolated from the slot resonator in high-frequency terms. On the other hand, in an operating state, only one selective radiation portion is to be connected to the feeding portion 601*a*, as shown in FIG. 5A or 5B. Note that, in the present invention, both selectively conducting means 601*d* and 601*e* are never controlled to be in an open state at the same time.

Table 1 below summarizes combinations of open/conducting states of the high-frequency switching elements 601*d* and 601*e* in relation to changes in the high-frequency circuit structure of the slot resonator 601.

TABLE 1

| | high-frequency switching element | | slot resonator construction | | |
|---|---|---|---|---|---|
| FIG. | 601d | 601e | operating/non-operating | feeding portion | selective radiation portion |
| 5A | open | conducting | operating | ○ | 601b |
| 5B | conducting | open | operating | ○ | 601c |
| 5C | conducting | conducting | non-operating | – | – |

The effective electrical lengths of the feeding portion and the selective radiation portions are prescribed so that the slot length of every slot resonator that is in an operating state always equals a ¼ effective wavelength. The length of the feeding portion is preferably shorter than the length of each selective radiation portion, and needs to be less than ⅛ effective wavelength, which is less than half of the total slot length.

Figure 25:
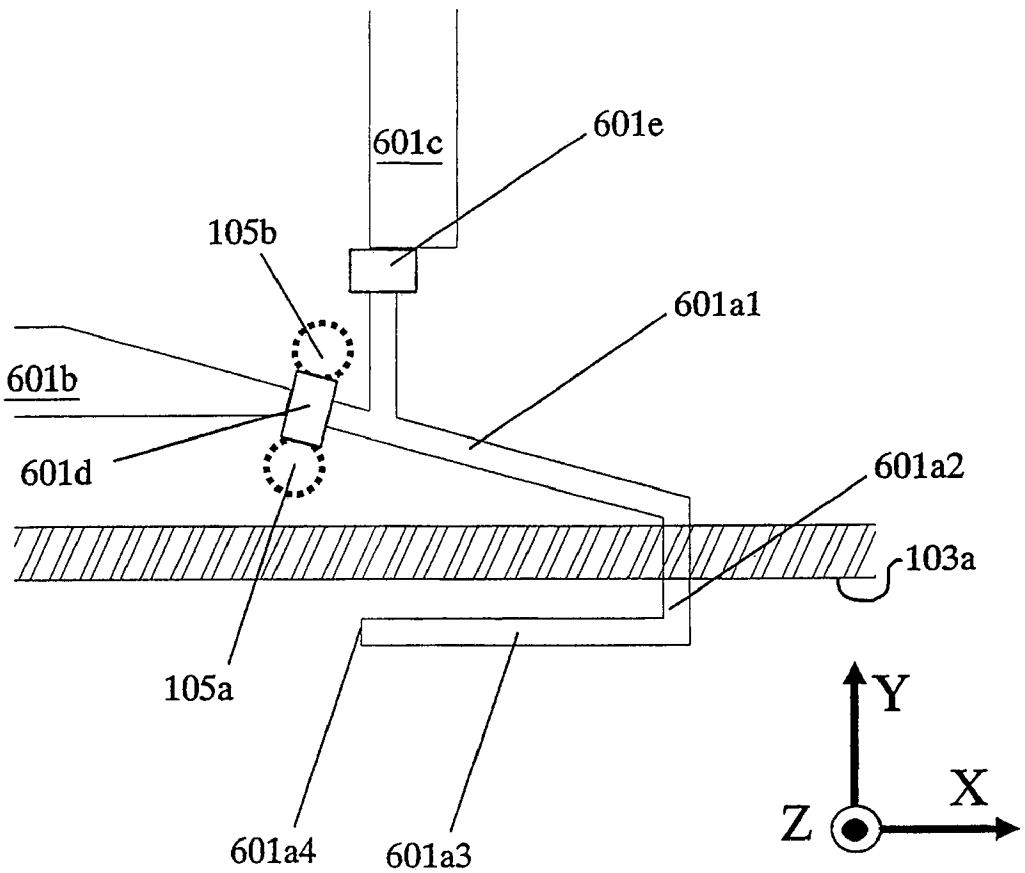
FIG. 25 is an enlarged view of a feeding portion 601.

Moreover, as shown in FIG. 25, in a place where it intersects a signal conductor, the feeding portion 601*a* must have a path that includes: a portion 601*a*1 which is connected to the selective radiation portions 601*b* and 601*c*; a component (portion) 601*a*2 which lies orthogonal to the signal conductor 103; and a component (portion) 601*a*3 which lies parallel to the signal conductor 103*a* between the aforementioned component (portion) 601*a*2 and a short-circuit end point 601*a*4 which is not connected to the selective radiation portions 601*b* and 601*c*. In other words, the feeding portion must always have a bent portion(s). In a differential transmission line, it is impossible to set a large gap width between the first and second signal conductors because increase in the characteristic impedance in the differential transmission mode must be avoided. Therefore, unless the aforementioned bent portion(s) is introduced, sufficient coupling between the first signal conductor and the first slot resonator will not be obtained. The same is also true of the coupling between the second signal conductor and the second slot resonator.

Figure 26:
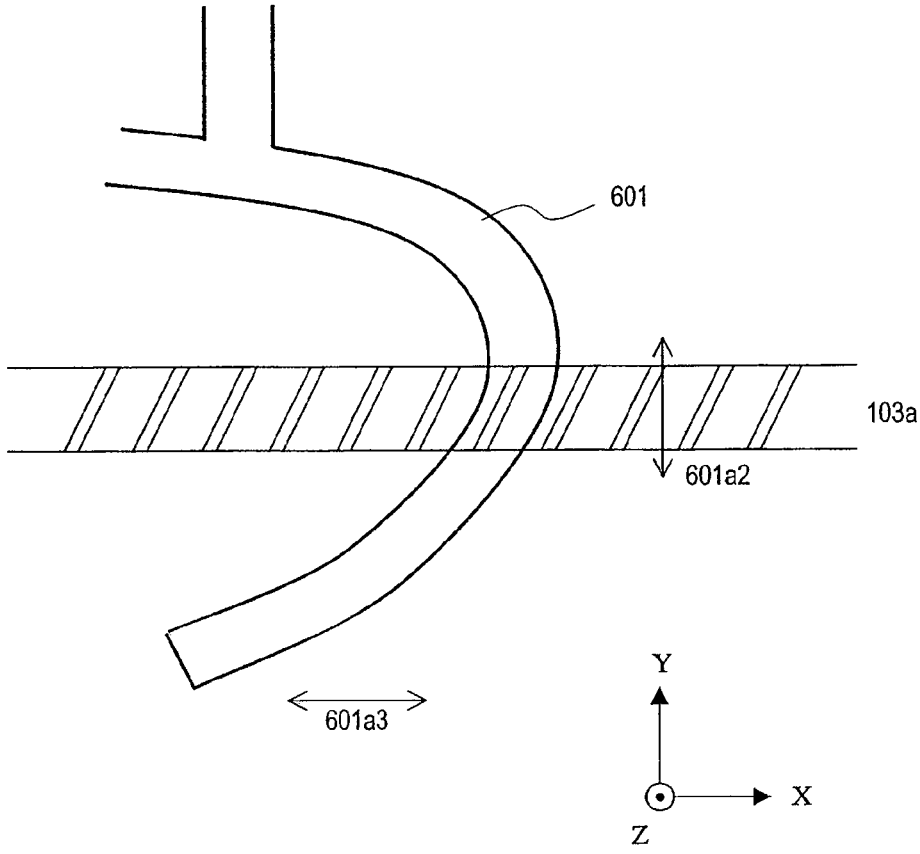
FIG. 26 is an enlarged view of another implementation of the feeding portion 601.

The reason why the notation "component (portion)" is used is that the feeding portion 601*a* does not need to have a portion 601*a*2 that is perfectly orthogonal to the signal conductor 103 and a portion 601*a*3 that is perfectly parallel to the signal conductor 103*a*. In other words, as shown in FIG. 26, the feeding portion 601*a* may be curved. As shown in FIG. 26, it suffices if this curved feeding portion 601*a* has a component 601*a*2 which is generally orthogonal to the signal conductor 103 (i.e., a Y direction component) and a component 601*a*3 which is generally parallel to the signal conductor 103 (i.e., an X direction component).

Moreover, the slot resonators always operate in a pair structure. In other words, the state of each slot resonator is controlled so that the number N1 of slot resonators that are coupled to the first signal conductor 103*a* so as to be in an operating state and the number N2 of slot resonators that are coupled to the second signal conductor 103*b* so as to be in an operating state are equal. Specifically, with respect to the construction of FIG. 1, combinations of slot resonators that can operate in a pair structure and combinations of slot resonators that cannot operate in a pair structure are summarized in Table 2.

TABLE 2

| | |
|---|---|
| Those which can form a pair structure | slot resonator 601 & slot resonator 603 |
| | slot resonator 605 & slot resonator 607 |
| | slot resonator 601 & slot resonator 607 |
| | slot resonator 603 & slot resonator 605 |
| Those which cannot be regarded as forming a pair structure | slot resonator 601 & slot resonator 605 |
| | slot resonator 603 & slot resonator 607 |

Note that the selective radiation portions 601*b* and 601*c* of the slot resonator according to the present invention are disposed so as to be, as viewed from the plane of mirror symmetry between the pair of signal conductors 103, on the side where the signal conductor which is coupled to the feeding portion 601*a* is located. For example, since the feeding portion 601*a* of the first slot resonator 601 is coupled to the first signal conductor 103*a*, the selective radiation portions 601*b* and 601*c* are to be disposed in the direction of the first signal conductor 103*a* as viewed from the plane of mirror symmetry between the pair of signal conductors 103.

Moreover, it is ensured that those slot resonators which operate in pair receive an equal intensity of power to be fed from the two signal conductors 103*a* and 103*b*. In order to satisfy this condition, the slot resonators which operate in pair may be disposed physically mirror symmetrical with respect to the two signal conductors 103*a* and 103*b*. Even in the case where a given pair of slot resonators are not disposed physically mirror symmetrical, similar effects can be realized by ensuring that the high-frequency characteristics of the pair of slot resonators are symmetrical. In other words, it suffices if those slot resonators which operate in pair have an equal resonant frequency and are coupled to the respective signal conductors with an equal intensity of coupling.

[Variability of Main Beam Orientation Based on Variability of Slot Shape]

Hereinafter, a method for controlling the slot resonators for realizing a radiation directivity which is very useful in practical use according to an embodiment of the present invention will be described.

Figure 6:
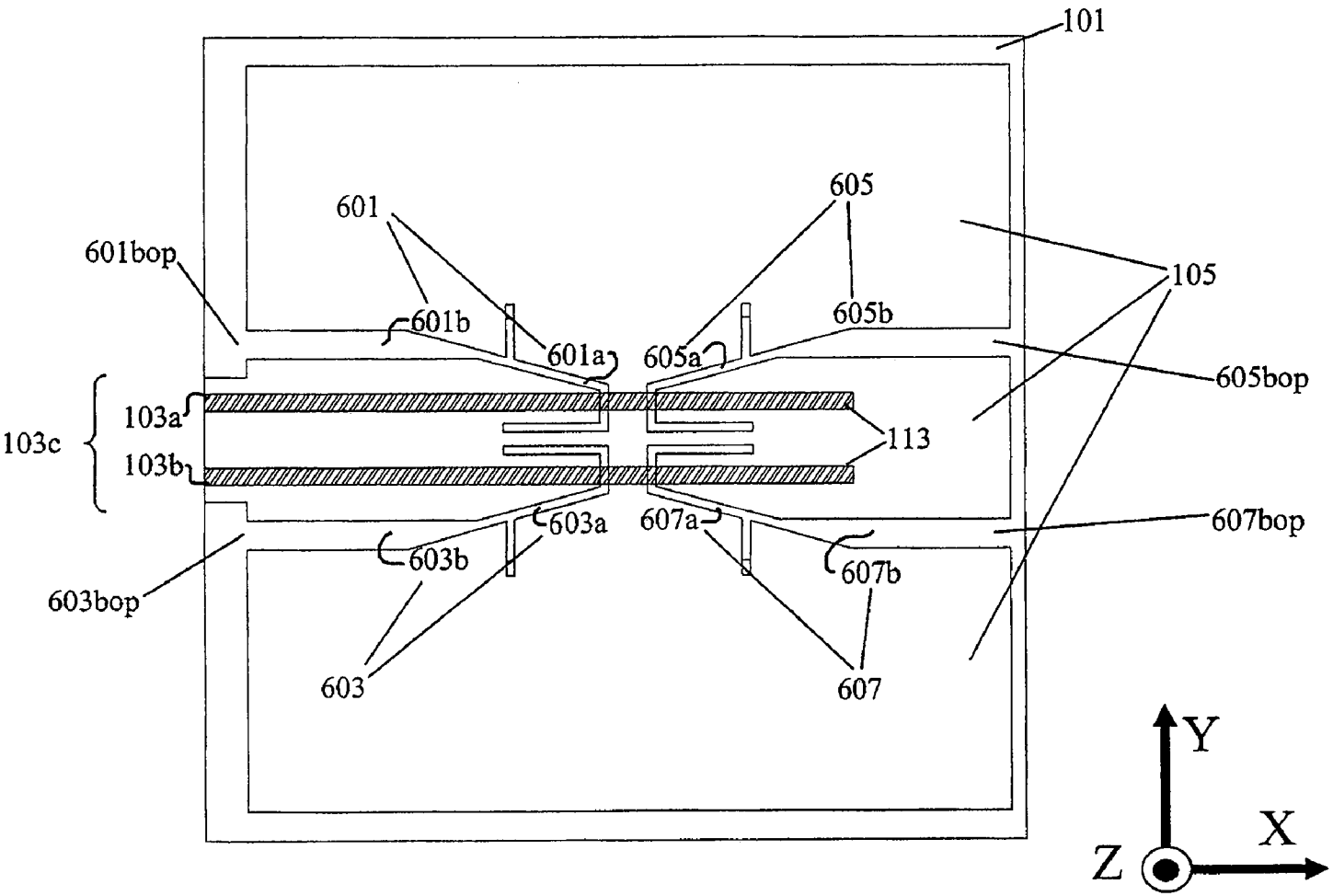
FIG. 6 is a structural diagram of a differentially-fed variable directivity slot antenna according to the present invention in a first control state.

First, in a first control state, the differentially-fed variable directivity slot antenna with the construction shown in FIG. 1 creates a high-frequency structure as shown in FIG. 6 by utilizing the RF structure reconfigurability function of the four slot resonators. Specifically, the first to fourth slot resonators are controlled so that the selective radiation portions 601*b* to 607*b* are selected while leaving the selective radiation portions 601*c* to 607*c* unselected. The unselected selective radiation portions are not shown in the figure. Through this control, a state is realized where two pairs of slot resonators exist on the ground conductor 105 which lie parallel to the X axis direction in the coordinate axes of the figure. In this first control state, the differentially-fed variable directivity antenna according to the present invention has radiation characteristics such that the main beam direction is oriented substantially symmetrically in the ±Y direction, while radiation into the XZ plane is forcibly suppressed. In other words, interference waves coming in any arbitrary direction within a plane that is orthogonal to the main beam direction can be efficiently suppressed. In the differentially-fed variable directivity antenna according to the present invention, signals which are of an equal amplitude and out of phase are input from the differential feed line to the highly symmetrical slot resonators which are combined in a pair structure. Therefore, a condition for allowing electric fields to cancel out each other in the far field is established across a wide range. In the antenna of Conventional Example 5 which realizes directivity switching by single-ended feeding, there is no signal which is of an equal amplitude and out of phase to cancel out the single-end signal that is being fed, so that a condition for obtaining a high gain suppression is not established, or if at all such is established, it will merely result in characteristics with a very limited angle range and a low degree of gain suppression. That is, only with the construction of the present invention can the effects of main beam direction control and gain suppression be simultaneously obtained.

In the first control state, the distance between the open end point 601*bop* of the first slot resonator and the open end point 603*bop* of the second slot resonator must be set to less than a ¼ effective wavelength at the operating frequency. Moreover, the distance between the open end point 605*bop* of the third slot resonator and the open end point 607*bop* of the fourth slot resonator must also be set to less than a ¼ effective wavelength at the operating frequency. Furthermore, the distance between the open end point 601*bop* and the open end point 605*bop* and the distance between the open end point 603*bop* and the open end point 607*bop* are each set to about ½ effective wavelength at the operating frequency. The contributions from two open end points which are apart by a distance less than a ¼ effective wavelength to the radiation into the far field are close to being in phase, with little phase difference associated with the positioning distance. On the other hand, the contributions from two open end points which are apart by a distance of about ½ effective wavelength to the radiation into the far field are close to being out of phase, because of a large phase difference associated with the positioning distance. From this relationship as well as the fact that the slot resonators in a pair structure are fed out-of-phase, it is possible to logically understand the relationship between the directions in which radiations enhance each other and the directions in which radiations cancel each other in the first control state.

Figure 7:
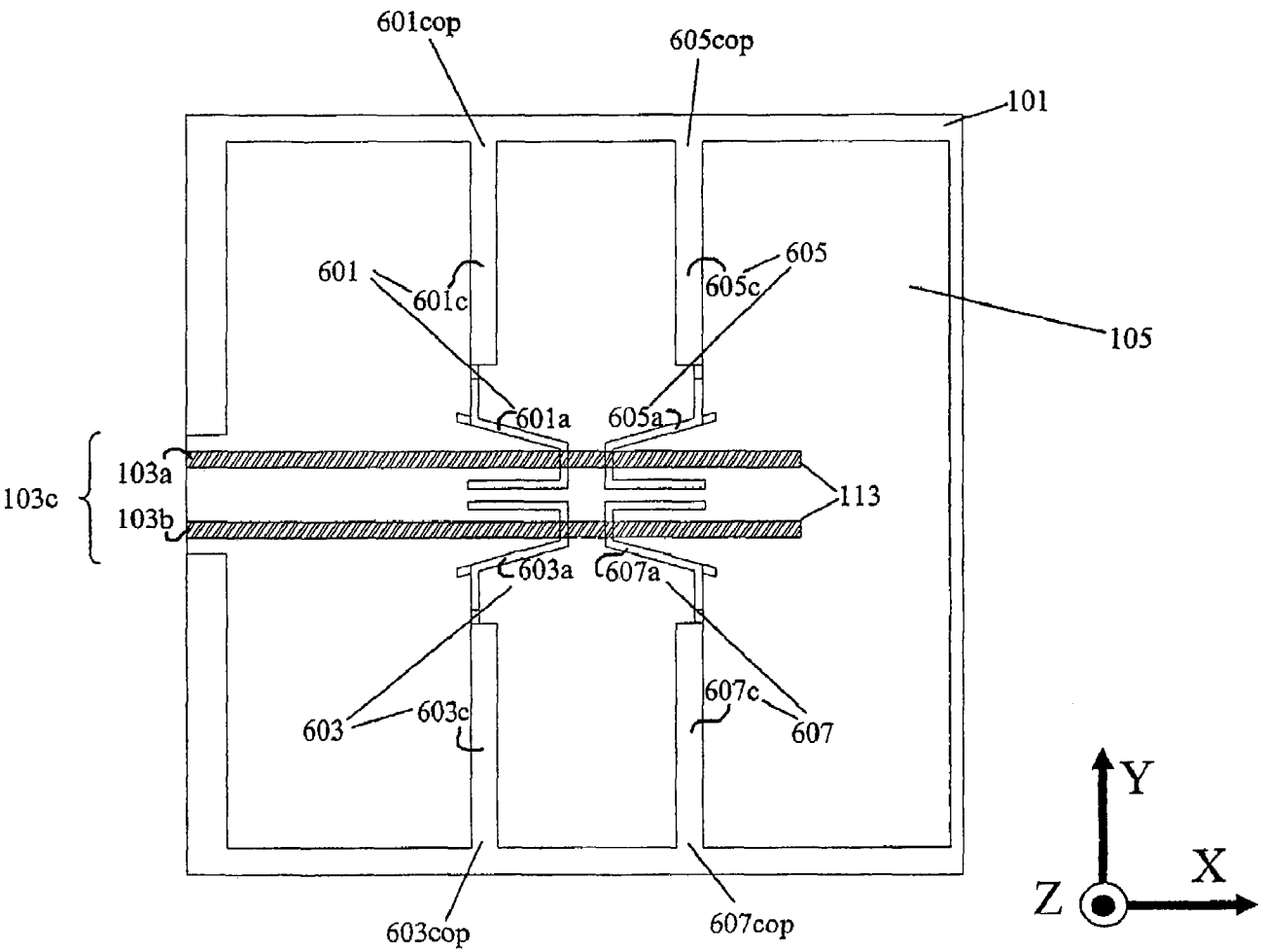
FIG. 7 is a structural diagram of a differentially-fed variable directivity slot antenna according to the present invention in a second control state.

Next, in a second control state, the differentially-fed variable directivity slot antenna with the construction shown in FIG. 1 creates a high-frequency structure as shown in FIG. 7 by utilizing the RF structure reconfigurability function of the four slot resonators. Specifically, the first to fourth slot resonators are controlled so that the selective radiation portions 601*c* to 607*c* are selected while leaving the selective radiation portions 601*b* to 607*b* unselected. Through this control, a state is realized where two pairs of slot resonators exist on the ground conductor 105 which lie parallel to the Y axis direction in the coordinate axes of the figure. In this second control state, the differentially-fed variable directivity antenna according to the present invention has radiation characteristics such that the main beam direction is oriented substantially symmetrical in the ±X direction, while radiation into the YZ plane is forcibly suppressed. In other words, also in the second control state, interference waves coming in any arbitrary direction within a plane that is orthogonal to the main beam direction can be efficiently suppressed. Furthermore, the respective main beam directions in the first control state and the second control state are completely orthogonal, and thus a wide solid angle range can be covered with a single antenna.

In the second control state, the distance between the open end point 601*cop* of the first slot resonator and the open end point 603*cop* of the second slot resonator and the distance between the open end point 605*cop* of the third slot resonator and the open end point 607*cop* of the fourth slot resonator are each set to about ½ effective wavelength at the operating frequency. Moreover, the distance between the open end point 601*cop* and the open end point 605*cop* and the distance between the open end point 603*cop* and the open end point 607*cop* must each be set to less than a ¼ effective wavelength at the operating frequency.

Figure 8:
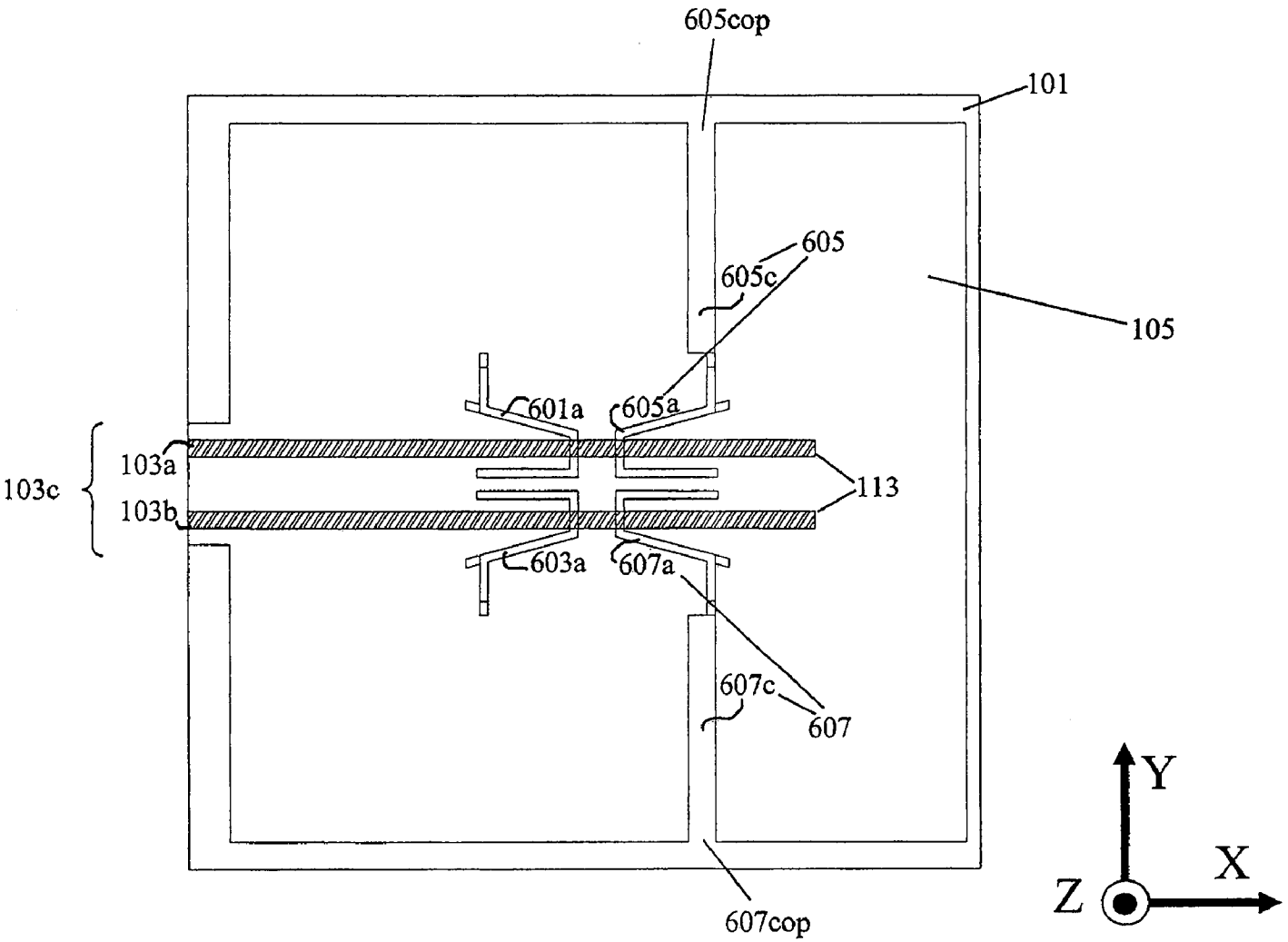
FIG. 8 is a structural diagram of a differentially-fed variable directivity slot antenna according to the present invention in a third operating state.

Next, in a third control state, the differentially-fed variable directivity slot antenna with the construction shown in FIG. 1 creates a high-frequency structure as shown in FIG. 8 by utilizing the RF structure reconfigurability function and the operation status switching function of the four slot resonators. Specifically, the first and second slot resonators are controlled to be in a non-operating state, and the selective radiation portion 605*c* and the selective radiation portion 607*c* in the third and fourth slot resonators are selected. The unselected selective radiation portions are not shown in the figure. Through this control, a state is realized where a pair of slot resonators exist which lie parallel to the Y axis direction in the coordinate axes of the figure.

In this third control state, the differentially-fed variable directivity antenna according to the present invention has radiation characteristics such that the main beam direction is broadly distributed in the XZ plane but slightly inclined in the −X direction, while radiation in the ±Y direction is forcibly suppressed. In a manner of encompassing all solid angles, this set of radiation characteristics is complementary to the set of radiation characteristics of the first control state, where radiation within the XZ plane is suppressed while only allowing radiation in the ±Y direction. This illustrates the high usefulness of the differentially-fed variable directivity antenna according to the present invention of being able to simultaneously satisfy both control states.

In the third control state, the distance between the open end point 605*cop* of the third slot resonator and the open end point 607*cop* of the fourth slot resonator is set to about ½ effective wavelength at the operating frequency.

Figure 9:
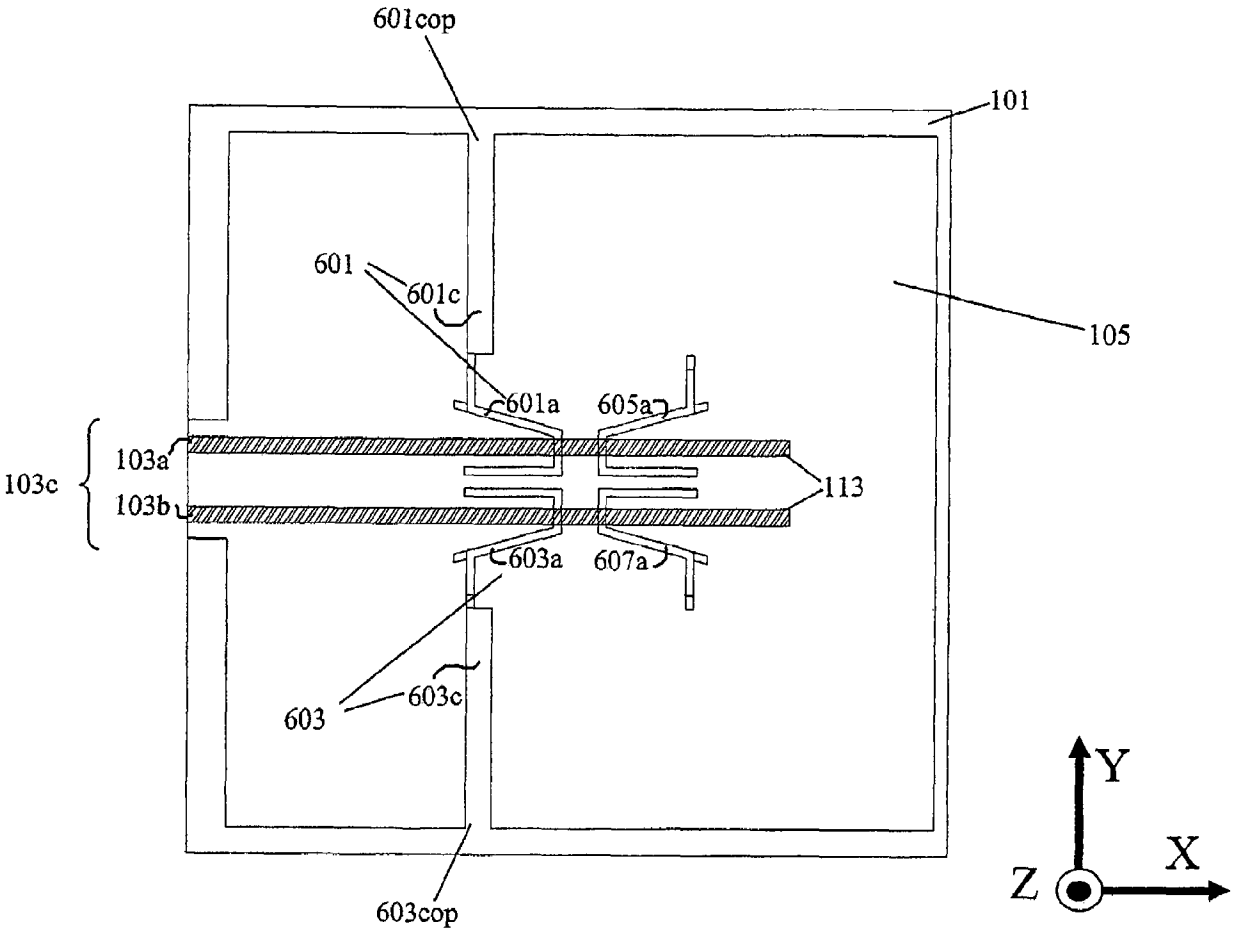
FIG. 9 is a structural diagram of a differentially-fed variable directivity slot antenna according to the present invention in a fourth operating state.

Next, in a fourth control state, the differentially-fed variable directivity slot antenna with the construction shown in FIG. 1 creates a high-frequency structure as shown in FIG. 9 by utilizing the RF structure reconfigurability function and the operation status switching function of the four slot resonators. Specifically, the third and fourth slot resonators are controlled to be in a non-operating state, and the selective radiation portion 601*c* and the selective radiation portion 603*c* in the first and second slot resonators are selected. The unselected selective radiation portions are not shown in the figure. Through this control, a state is realized where a pair of slot resonators exist which lie parallel to the Y axis direction in the coordinate axes of the figure. The fourth control state differs from the third control state in terms of relative positioning between the feeding portion for the slot resonator pair and the differential feed line 103*c*. Similarly to the third control state, the fourth control state attains radiation characteristics such that the main beam direction is broadly distributed in the XZ plane, while radiation in the ±Y direction is forcibly suppressed. In other words, the fourth control state also attains a set of radiation characteristics that is complementary to the set of radiation characteristics of the first control state in a manner of encompassing all solid angles, although a difference in high-frequency structure from the third control state appears in a tilt of the main beam direction. Specifically, radiation characteristics are realized such that the main beam direction is broadly distributed in the XZ plane similarly to the third control state, but slightly inclined in the +X direction.

Thus, with the differentially-fed variable directivity slot antenna according to the present invention, not only is it possible to obtain efficient radiation in the ±Y direction (in which it has conventionally been difficult to attain efficient radiation by differential feeding), but it is also possible to realize a directivity switching function in a wide range of solid angles. Furthermore, in each control state, it is possible to obtain a gain suppression effect according to natural principles in directions which would be the main beam directions in other control states.

Figure 10:
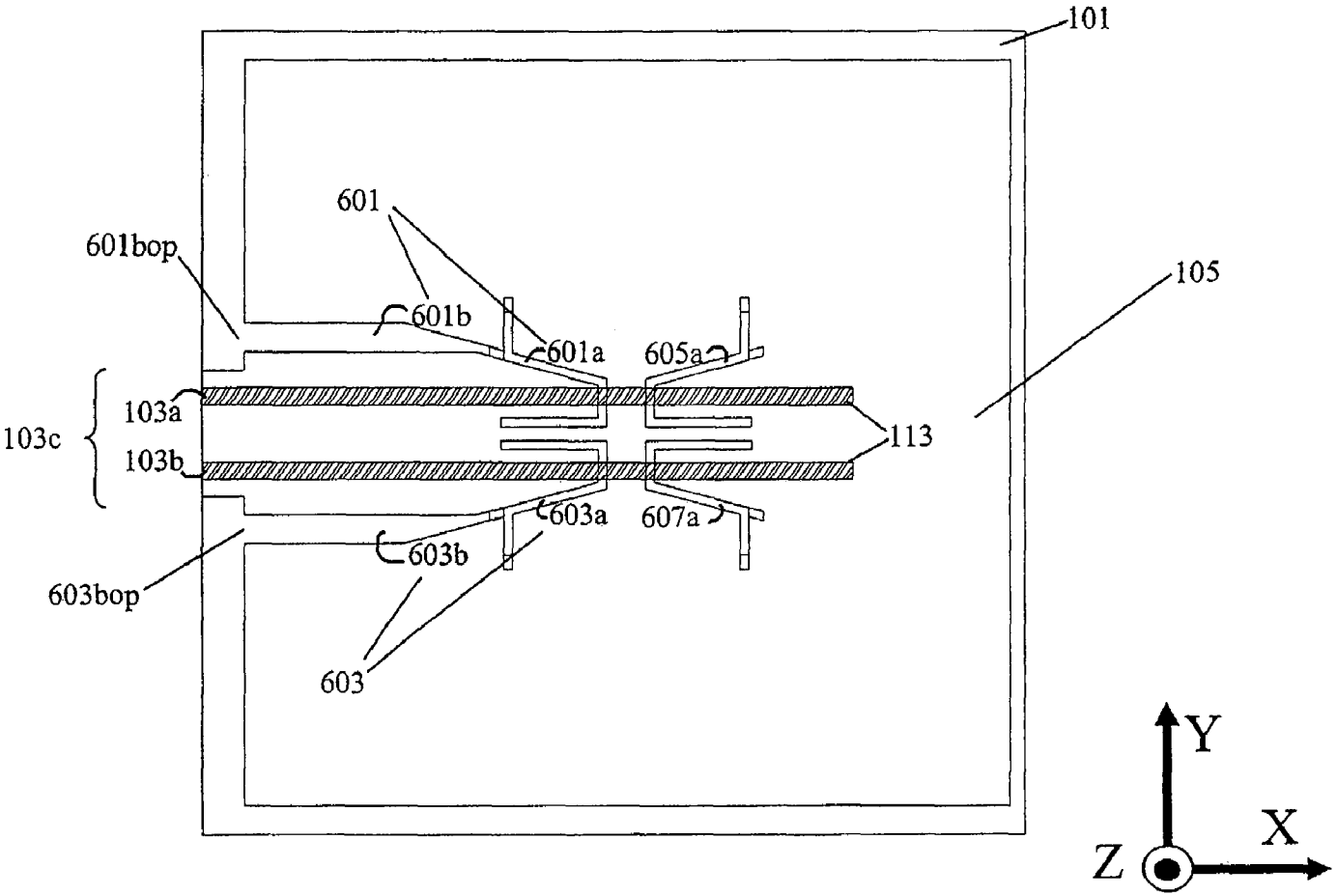
FIG. 10 is a structural diagram of a differentially-fed variable directivity slot antenna according to the present invention in a fifth operating state.
Figure 11A:
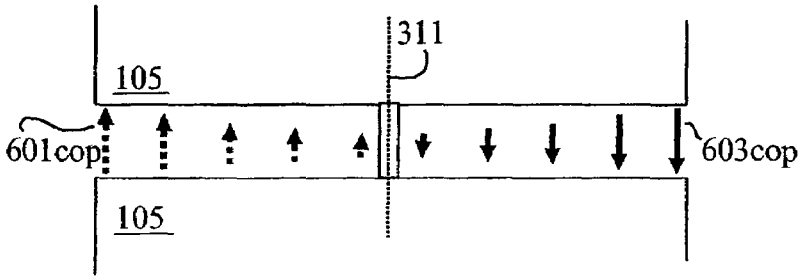
FIG. 11A is a schematic diagram showing electric field vectors occurring within an open-ended ¼ effective wavelength slot resonator pair when the slot resonators undergo out-of-phase excitation.
Figure 11B:
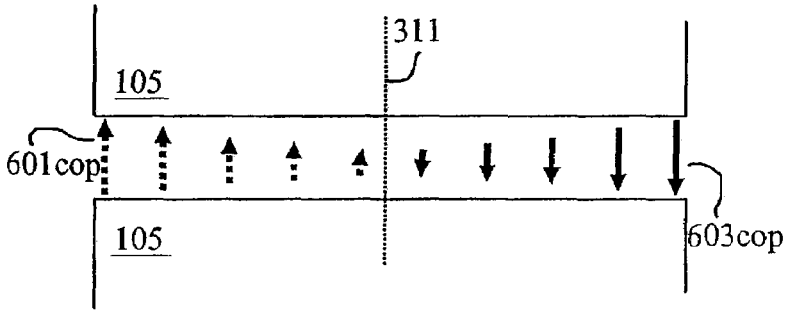
FIG. 11B is a schematic diagram showing electric field vectors occurring within ½ effective wavelength slot resonators with open both ends when the slot resonators undergo out-of-phase excitation.
Figure 11C:
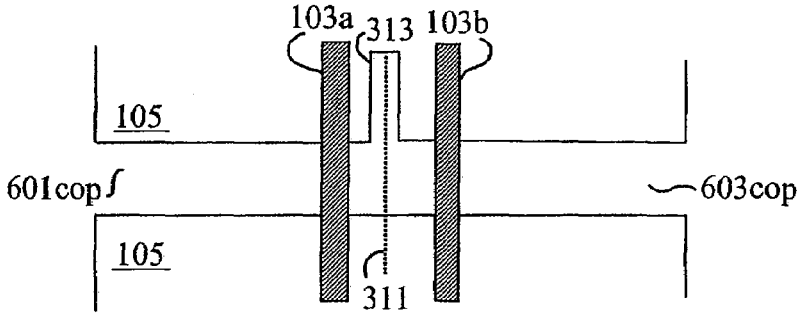
FIG. 11C is a schematic diagram showing a relationship between ½ effective wavelength slot resonators with open both ends and a differential feed line in a differentially-fed variable directivity slot antenna according to the present invention.

Moreover, in a fifth control state, the differentially-fed variable directivity slot antenna with the construction shown in FIG. 1 creates a high-frequency structure as shown in FIG. 10 by utilizing the RF structure reconfigurability function and the operation status switching function of the four slot resonators. Specifically, the third and fourth slot resonators are controlled to be in a non-operating state, and the selective radiation portion 601*b* and the selective radiation portion 603*b* in the first and second slot resonators are selected. The unselected selective radiation portions are not shown in the figure. Through this control, a state is realized where a pair of slot resonators exist which lie parallel to the X axis direction in the coordinate axes of the figure. Also in this fifth control state, it is possible to allow the main beam direction to be broadly distributed in the XZ plane. Moreover, in this control state, the degree of gain suppression on the radiation from the ±Y direction relative to the main beam is less than 10 dB, thus making it possible to provide radiation characteristics which are optimum for applications where strong gain suppression is not desired. In other words, the differentially-fed variable directivity slot antenna according to the present invention can even realize radiation characteristics which are optimum for the purpose of waiting on a desired wave that may possibility arrive in a wide range of solid angles.

The differential feed line 103*c* may be left open-ended at an end point 113. By setting the feed matching length from the end point 113 to the feeding portion of each of the slot resonators 601, 603, 605, and 607 so as to be a ¼ effective wavelength with respect to the differential transmission mode propagation characteristics in the differential line at the operating frequency, the input matching characteristics for the slot resonators can be improved. At the end point of the differential feed line 103*c*, the first signal conductor 103*a* and the second signal conductor 103*b* may be grounded via resistors of an equal value. At the end point of the differential feed line 103*c*, the first signal conductor 103*a* and the second signal conductor 103*b* may be connected to each other via a resistor. If a resistor(s) is introduced at the end point of the differential feed line, some of the input power to the antenna circuit will be consumed in the introduced resistor(s), and thus a decrease in radiation efficiency will result. However, such a resistor(s) will allow the input matching condition for the slot resonators to be relaxed, thus making it possible to reduce the value of feed matching length.

As a method for implementing the high-frequency switching elements 601*d*, 601*e*, 603*d*, 603*e*, 605*d*, 605*e*, 607*d*, and 607*e*, diode switches, high-frequency switches, MEMS switches or the like are available. For example, by using commercially-available diode switches, good switching characteristics with a series resistance value of 5Ω in a conducting state and a parasitic series capacitance value of about 0.05 pF in an open state can be easily obtained in a frequency band of 20 GHz or less, for example.

As described above, by adopting the structure of the present invention, there is provided a variable antenna which is capable of directing the main beam in a direction which cannot be achieved with a conventional slot antenna or differentially-fed antenna, switching the main beam direction in a wide solid angle range, and suppressing the radiation gain mainly in directions which are orthogonal to the main beam direction, such that all solid angles are encompassed in a complementary manner.

EXAMPLES

On an FR4 substrate measuring 30 mm along the X axis direction, 32 mm along the Y axis direction, and 1 mm along the Z axis direction, a differentially-fed variable directivity slot antenna according to the present invention as shown in FIG. 1 was fabricated. On the substrate surface, a differential feed line 103*c* having a line width of 1.3 mm and a line-to-line gap of 1 mm was formed. From a ground conductor 105 formed on the entire substrate rear face, the conductor was removed in partial regions by wet etching, thus realizing a slot structure. The conductor was a piece of copper having a thickness of 35 microns. The four slot resonators were all made identical in shape. The slot resonator 601 and the slot resonator 603 were placed so as to be mirror symmetrical; and so were the slot resonator 605 and the slot resonator 607. Furthermore, the slot resonator 601 and the slot resonator 605 were placed so as to be mirror symmetrical; and so were the slot resonator 603 and the slot resonator 607.

The plane of mirror symmetry was defined as X=0. The differential signal line 103*c* was left open-ended at X=14.5. The slot width was 0.5 mm at places illustrated as being thin in the figure and 1 mm at places illustrated as being thick in the figure. The closest distance between the respective feeding portions of the slot resonator 601 and the slot resonator 605 was 1.5 mm, and the bent portion of the slot resonator of each feeding portion had a length of 5 mm. The closest distance between the respective bent portions of the feeding portion 601*a* and the feeding portion 603*a* was 0.2 mm.

In the Examples, a commercially available PIN diode was used as each high-frequency switch. Each switch operated with a DC resistance of 4Ω in a conducting state, and functioned as a 30 fF DC capacitance in an open state. Through controlling of the high-frequency switches, operation was obtained in five control states. At 2.57 GHz, each state realized return intensity characteristics such that a sufficiently low value of less than −10 dB was obtained in response to a differential signal input.

Hereinafter, radiation characteristics obtained in each control state will be described. In each control state, there was only less than −30 dB of an in-phase mode signal return intensity in response to a differential signal input.

First Example

Figures 12A, 12B, 12C:
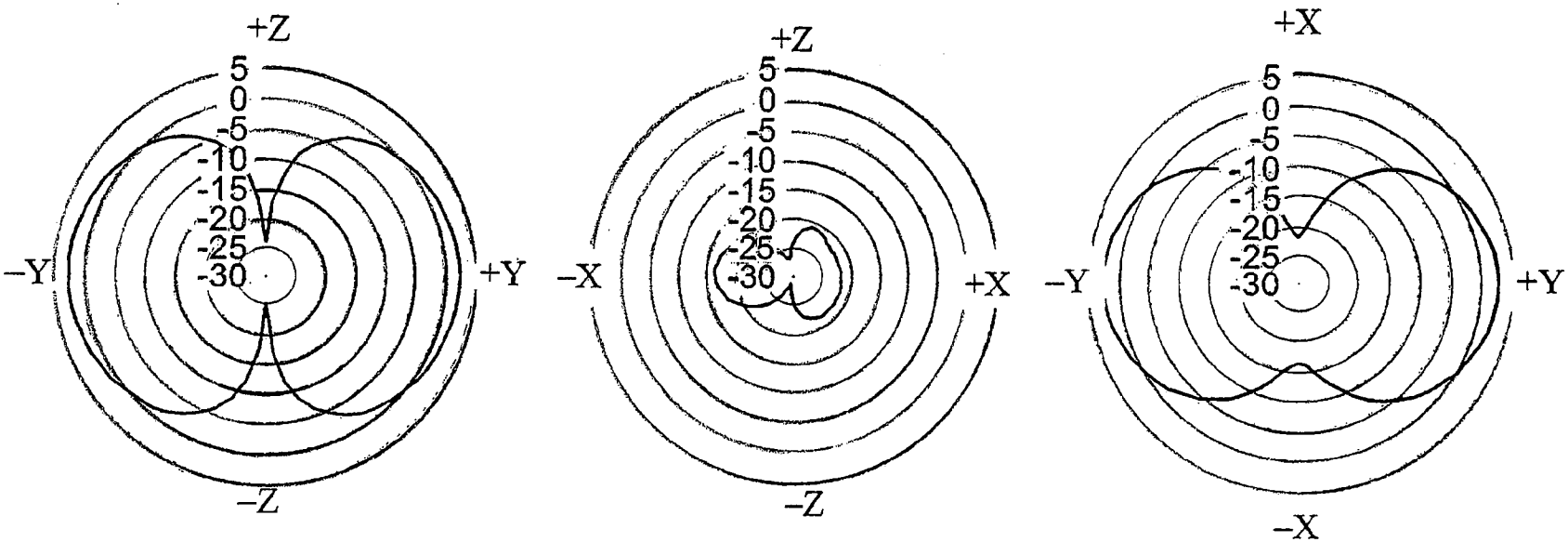
FIGS. 12A to 12C are radiation pattern diagrams of a First Example of the present invention.

In the First Example, the high-frequency switches of each slot resonator were controlled so as to realize the first control state shown in FIG. 6. A radiation pattern on each coordinate plane in this Example is shown in FIG. 12. As is clear from FIG. 12, it was proven that the first control state realizes a main beam direction being oriented in the ±Y direction. In the Z axis direction, a gain suppression effect exceeding 25 dB was obtained relative to the gain in the main beam direction. In the X axis direction, too, a gain suppression effect of almost 20 dB was obtained relative to the gain in the main beam direction.

Second Example

Figures 13A, 13B, 13C:
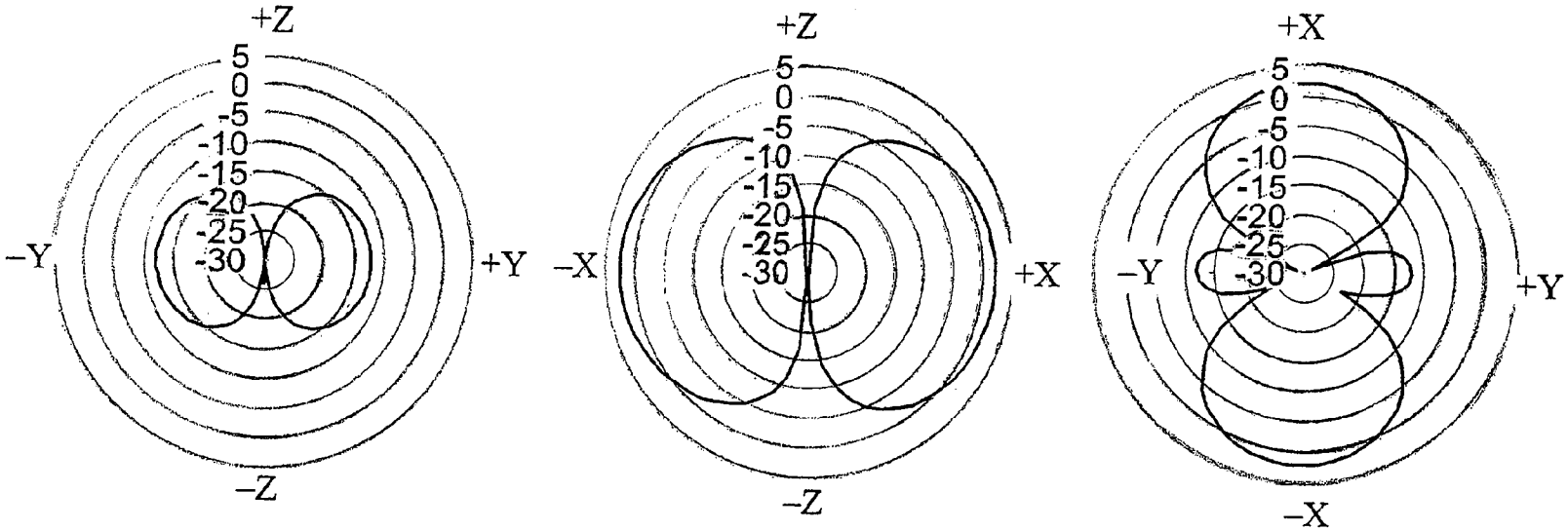
FIGS. 13A to 13C are radiation pattern diagrams of a Second Example of the present invention.

In the Second Example, the high-frequency switches of each slot resonator were controlled so as to realize the second control state shown in FIG. 7. A radiation pattern on each coordinate plane in this Example is shown in FIG. 13. As is clear from FIG. 13, it was proven that the second control state realizes a main beam direction being oriented in the ±X direction. In the Z axis direction, a gain suppression effect exceeding 30 dB was obtained relative to the gain in the main beam direction. In the Y axis direction, too, a strong gain suppression effect exceeding 15 dB was obtained relative to the gain in the main beam direction.

Third Example

Figures 14A, 14B, 14C:
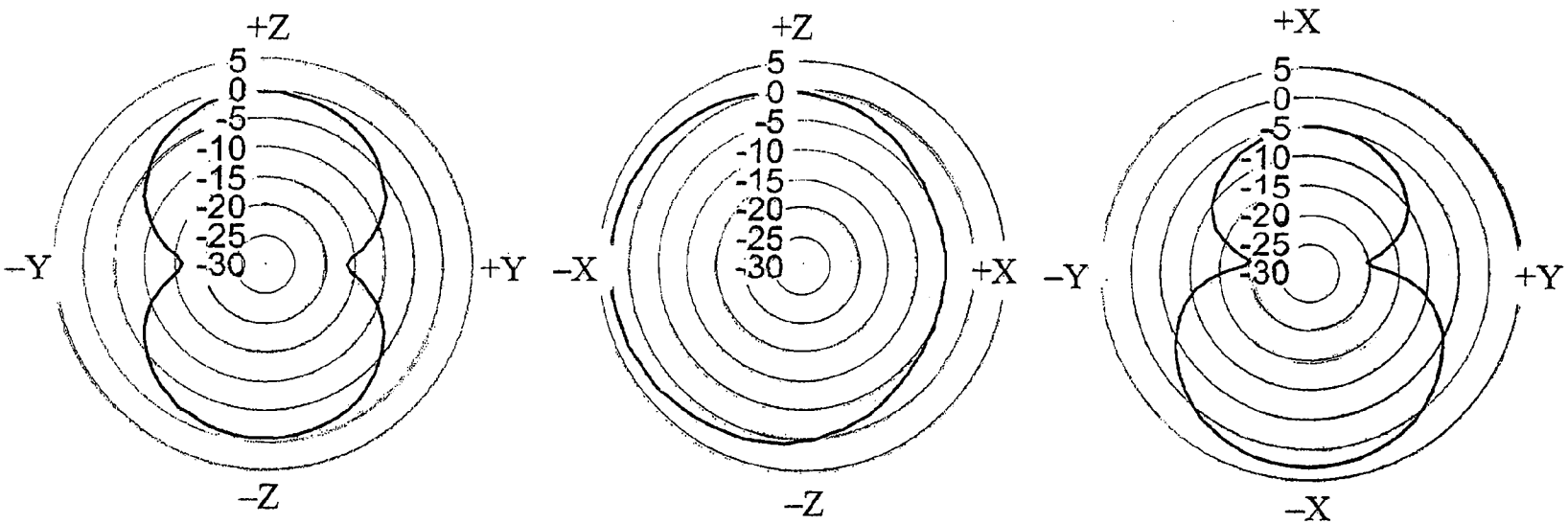
FIGS. 14A to 14C are radiation pattern diagram of a Third Example of the present invention.

In the Third Example, the high-frequency switches of each slot resonator were controlled so as to realize the third control state shown in FIG. 8. A radiation pattern on each coordinate plane in this Example is shown in FIG. 14. As is clear from FIG. 14, it was proven that the third control state realizes a radiation which is distributed in the XZ plane, in particular a main beam direction being oriented in the −X direction. In the Y axis direction, a strong gain suppression effect exceeding 25 dB was obtained relative to the gain in the main beam direction.

Fourth Example

Figures 15A, 15B, 15C:
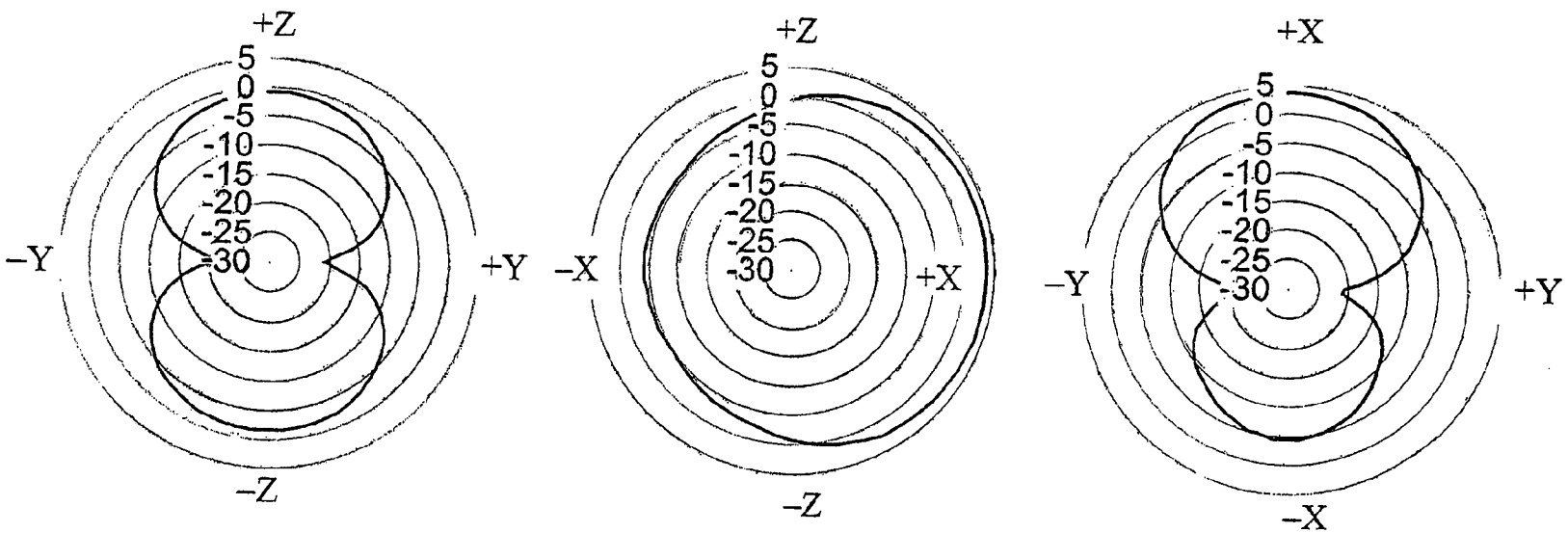
FIGS. 15A to 15C are radiation pattern diagrams of a Fourth Example of the present invention.

In the Fourth Example, the high-frequency switches of each slot resonator were controlled so as to realize the fourth control state shown in FIG. 9. A radiation pattern on each coordinate plane in this Example is shown in FIG. 15. As is clear from FIG. 15, it was proven that the fourth control state realizes a radiation which is distributed in the XZ plane, in particular a main beam direction being oriented in the +X direction. In the Y axis direction, a strong gain suppression effect exceeding 25 dB was obtained relative to the gain in the main beam direction.

Fifth Example

Figure 16C:
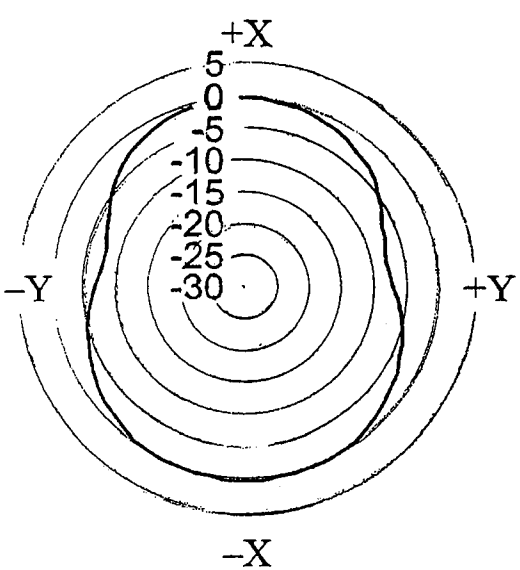
FIGS. 16A to 16C are radiation pattern diagrams of a Fifth Example of the present invention.
Figure 16B:
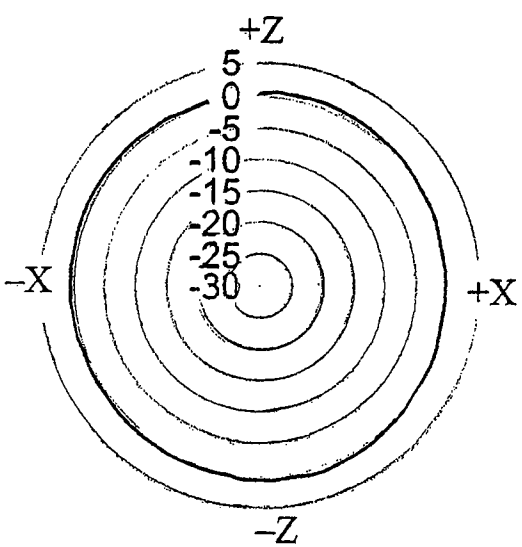
Figure 16A:
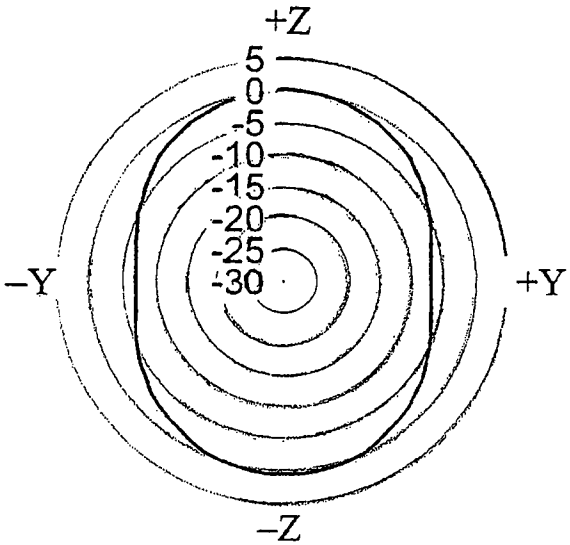
Figure 18B:
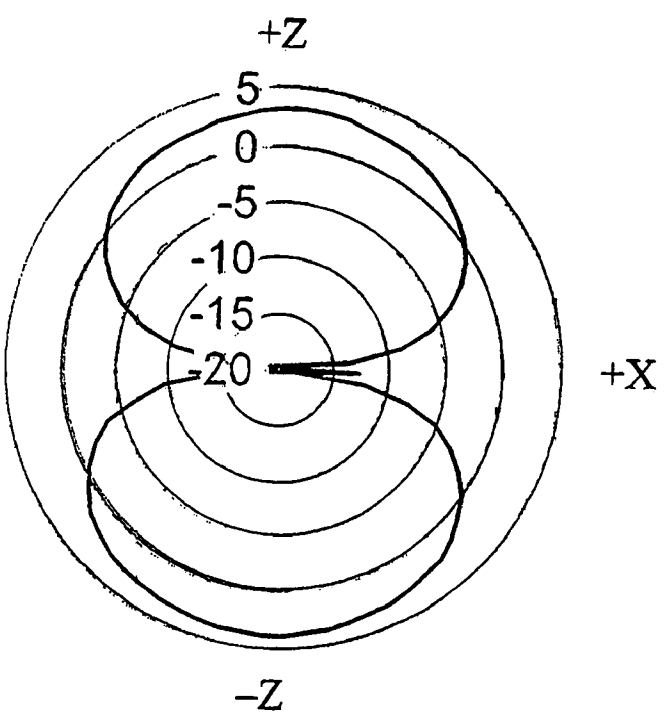
FIGS. 18A and 18B are radiation directivity characteristics diagrams of Conventional Example 1.
Figure 18A:
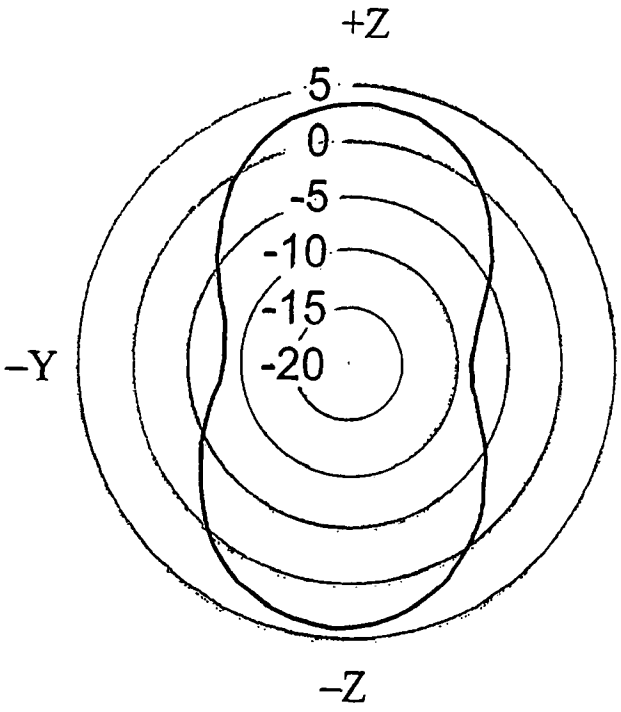
Figures 20A, 20B, 20C:
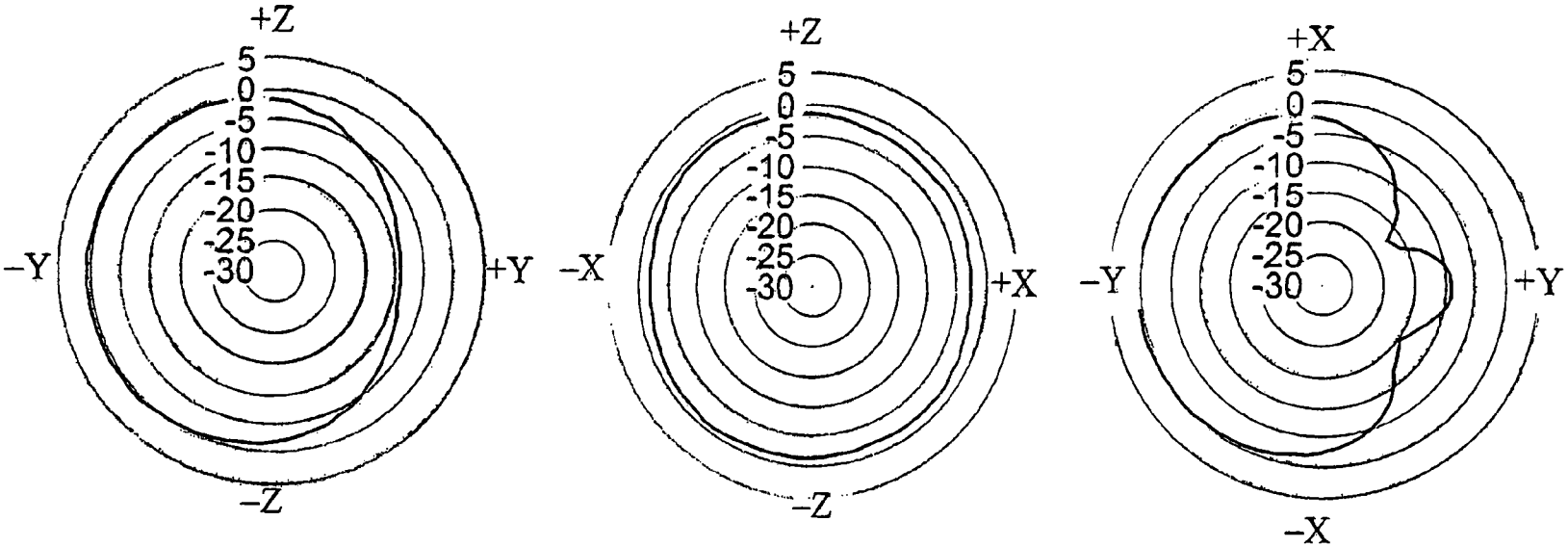
FIGS. 20A and 20B are radiation directivity characteristics diagrams of Conventional Example 1.
FIG. 20C is a radiation directivity characteristics diagram in the XY plane.
Figure 21A:
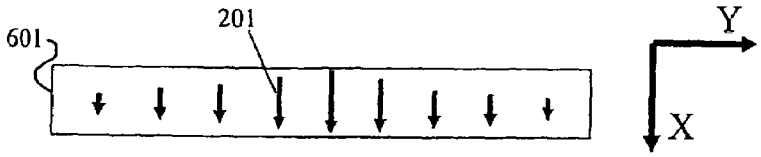
FIGS. 21A and 21B are schematic diagrams of field vector distributions within a ½ wavelength slot resonator.
Figure 21B:
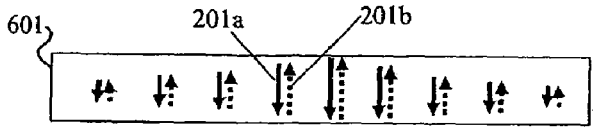
Figure 23B:
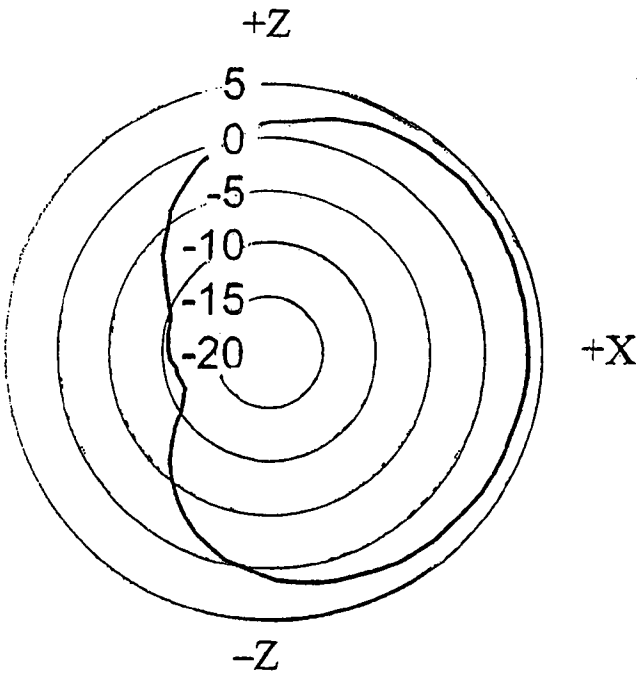
FIGS. 23A and 23B are radiation directivity characteristics diagrams of a differentially-fed strip antenna of Conventional Example 4.
Figure 23A:
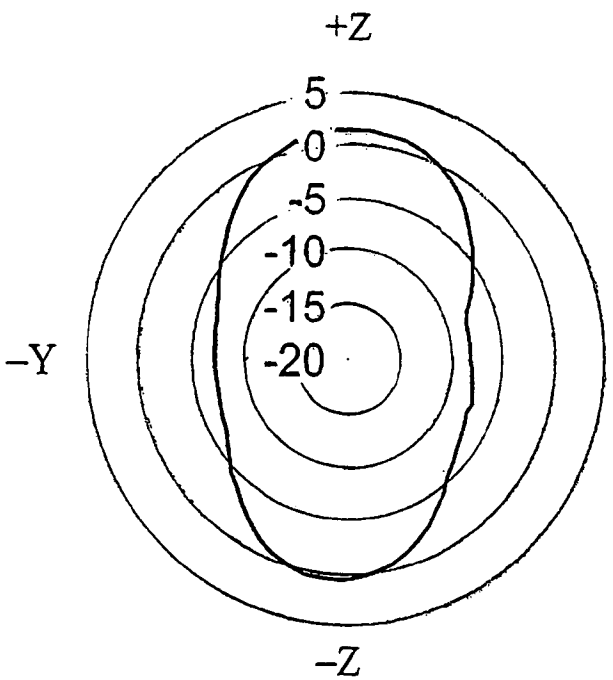

In the Fifth Example, the high-frequency switches of each slot resonator were controlled so as to realize the fifth control state shown in FIG. 10. A radiation pattern on each coordinate plane in this Example is shown in FIG. 16. As is clear from FIG. 16, it was proven that the fifth control state realizes a broad radiation distributed in the XZ plane. Unlike in the fourth control state, radiation characteristics were realized such that only a gain decrease of about 7 dB was obtained in the Y axis direction, relative to the gain in the main beam direction.

The differentially-fed variable directivity slot antenna according to the present invention is able to perform efficient radiations in various directions, including directions in which radiation is difficult to be provided by conventional differentially-fed antennas. Not only is it possible to realize a variable directivity antenna that encompasses all solid angles based on a wide range of angles in which the main beam direction is switchable, but it is also possible, according to natural principles, to suppress directivity gains in directions which are orthogonal to the main beam direction.

Furthermore, for the radiation characteristics which are realized in a given control state, it is possible to obtain complementary radiation characteristics in another control state, according to natural principles. Thus, the present invention is useful for the purpose of realizing high-speed communications in indoor environments with profuse multipaths, in particular. The present invention is not only applicable to a broad range of purposes pertaining to the field of communications, but can also be used in various fields employing wireless technology, e.g., wireless power transmission and ID tags.

While the present invention has been described with respect to preferred embodiments thereof, it will be apparent to those skilled in the art that the disclosed invention may be modified in numerous ways and may assume many embodiments other than those specifically described above. Accordingly, it is intended by the appended claims to cover all modifications of the invention that fall within the true spirit and scope of the invention.

What is claimed is:

1. A differentially-fed variable directivity slot antenna comprising:

a dielectric substrate (101);

a ground conductor (105) provided on a rear face of the dielectric substrate, the ground conductor having a finite area;

a differential feed line (103*c*) disposed on a front face of the dielectric substrate, the differential feed line being composed of two mirror symmetrical signal conductors (103*a*, 103*b*);

a first slot resonator (601, 605) formed in the ground conductor (105), a portion of the first slot resonator intersecting one (103*a*) of the signal conductors (103*a*, 103*b*), the first slot resonator having a slot length corresponding to a ¼ effective wavelength at an operating frequency and having an open end; and a second slot resonator (603, 607) formed in the ground conductor (105), a portion of the second slot resonator intersecting the signal conductor (103*b*) other than the signal conductor (103*a*) intersected by the portion of the first slot resonator, the second slot resonator having a slot length corresponding to a ¼ effective wavelength at the operating frequency and having an open end, wherein, the first slot resonator (601, 605) and the second slot resonator (603, 607) are fed out-of-phase, and at least one of the slot resonators (601, 603, 605, 607) has at least one function of an RF structure reconfigurability function and an operation status switching function, thus realizing two or more different radiation directivities;

the first and second slot resonators (601, 603, 605, 607) each comprise a series connection structure including a feeding portion (601*a* to 607*a*) partly intersecting the signal conductor (103*a*, 103*b*) and a selective radiation portion (601*b*, 601*c*, 603*b*, 603*c*, 605*b*, 605*c*, 607*b*, 607*c*) not intersecting the signal conductor (103*a*, 103*b*);

in a region facing a region between the first signal conductor and the second signal conductor, at least a portion of the feeding portion has a component being oriented in a direction parallel to the signal conductors and extending a length of less than a ⅛ effective wavelength to be short-circuit-ended;

the selective radiation portion is open-ended at a leading end opposite from an end where the selective radiation portion is connected to the feeding portion;

in the at least one slot resonator (601, 603, 605, 607) having the at least one function, a plurality of said selective radiation portions are connected to the feeding portion, with a high-frequency switch (601*d*, 601*e*) being inserted so as to straddle the slot resonator along a width direction in at least one place in a path from the feeding portion to each of the open points (601*bop*, 601*cop* to 607*bop*, 607*cop*) of the plurality of selective radiation portions, each high-frequency switch providing control as to whether or not to short-circuit the ground conductor on both sides astride the slot resonator;

the RF structure reconfigurability function is realized by one of the plurality of selective radiation portions being selected via the high-frequency switches to form a slot structure together with the feeding portion; and the operation status switching function is realized by the high-frequency switches short-circuiting each slot structure.

2. The differentially-fed variable directivity slot antenna of claim 1, wherein the first slot resonator and the second slot resonator are each fed at a point whose distance from an open end of the differential feed line toward the feed circuit corresponds to a ¼ effective wavelength at the operating frequency.

3. The differentially-fed variable directivity slot antenna of claim 1, wherein an end point of the differential feed line is grounded via resistors of a same resistance value.

4. The differentially-fed variable directivity slot antenna of claim 1, wherein an end point of the first signal conductor and an end point of the second signal conductor are electrically connected to each other via a resistor.

5. The differentially-fed variable directivity slot antenna of claim 1, wherein, one of the two or more different radiation directivities is a radiation directivity being orthogonal to the differential feed line and having radiation components in two directions which are parallel to the dielectric substrate, the radiation directivity being realized by:

designating two pairs of slot resonators, in each of which a first open leading portion of a first selective radiation portion of the first slot resonator and a second open leading portion of a second selective radiation portion of the second slot resonator are disposed at a distance of less than a ¼ effective wavelength at the operating frequency from each other;

disposing the first open leading portion in the first pair of slot resonators and the first open leading portion in the second pair of slot resonators so as to be apart by about ½ effective wavelength at the operating frequency; and disposing the second open leading portion in the first pair of slot resonators and the second open leading portion in the second pair of slot resonators so as to be apart by about ½ effective wavelength at the operating frequency.

6. The differentially-fed variable directivity slot antenna of claim 1, wherein, one of the two or more different radiation directivities is a radiation directivity having radiation components in two directions which are parallel to the differential feed line, the radiation directivity being realized by:

designating two pairs of slot resonators, in each of which a first open leading portion of a first selective radiation portion of the first slot resonator and a second open leading portion of a second selective radiation portion of the second slot resonator are separated by about a ½ effective wavelength at the operating frequency from each other;

disposing the first open leading portion in the first pair of slot resonators and the first open leading portion in the second pair of slot resonators so as to be apart by about ½ effective wavelength at the operating frequency; and disposing the second open leading portion in the first pair of slot resonators and the second open leading portion in the second pair of slot resonators so as to be apart by about ½ effective wavelength at the operating frequency.

7. The differentially-fed variable directivity slot antenna of claim 1, wherein, one of the two or more different radiation directivities is realized by:

disposing the first open leading portion of the first selective radiation portion of the first slot resonator and the second open leading portion of the second selective radiation portion of the second slot resonator so as to be apart by about ½ effective wavelength at the operating frequency; and setting only one pair of slot resonators in the differentially-fed variable directivity slot antenna into an operating state to operate in pair, whereby, a radiation gain in a first direction connecting the first open leading portion and the second open leading portion is suppressed; and a main beam is directed in a direction within a plane which is orthogonal to the first direction.

* * * * *